US007192350B2

(12) United States Patent
Nguyen

(10) Patent No.: US 7,192,350 B2
(45) Date of Patent: Mar. 20, 2007

(54) PAYOUT EXCHANGE METHOD AND SYSTEM

(75) Inventor: Binh T. Nguyen, Reno, NV (US)

(73) Assignee: IGT, Reno, NV (US)

( * ) Notice: Subject to any disclaimer, the term of this patent is extended or adjusted under 35 U.S.C. 154(b) by 341 days.

(21) Appl. No.: 10/934,706

(22) Filed: Sep. 2, 2004

(65) Prior Publication Data

US 2006/0046839 A1 Mar. 2, 2006

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 5,816,918 | A | 10/1998 | Kelly et al. | 463/16 |
| 6,015,344 | A | 1/2000 | Kelly et al. | 463/16 |
| 6,358,147 | B1 | 3/2002 | Jaffe et al. | |
| 6,811,483 | B1 | 11/2004 | Webb et al. | |
| 6,814,664 | B2 | 11/2004 | Baerlocher et al. | |
| 2001/0034259 | A1 | 10/2001 | Luciano et al. | 463/16 |
| 2004/0106449 | A1 | 6/2004 | Walker et al. | |
| 2004/0143495 | A1 | 7/2004 | Koenig | |
| 2004/0242297 | A1 | 12/2004 | Walker et al. | |

FOREIGN PATENT DOCUMENTS

| | | |
|---|---|---|
| WO | WO 01/64306 A2 | 9/2001 |
| WO | WO 01/64306 A3 | 9/2001 |

*Primary Examiner*—Corbett B. Coburn
(74) *Attorney, Agent, or Firm*—Bell, Boyd & Lloyd LLP

(57) ABSTRACT

A gaming method includes receiving a wager from a first player, displaying an image representative of a game, determining an outcome for the game represented by the image, and associating a first payout with the first player according to the outcome. The method also includes receiving an exchange of communications between the first player and a second player regarding an exchange of the first payout and a second payout, associating the second payout with the first player, and associating the first payout with the second player.

42 Claims, 18 Drawing Sheets

PAYOUT EXCHANGE METHOD AND SYSTEM

BACKGROUND

This patent is directed to a method and system for exchanging payouts among participants of a gaming system, and in particular to a method and system for transferring at least a first payout awarded to a first player from the first player to a second player in exchange for transferring at least a second payout awarded to the second player from the second player to the first player.

SUMMARY OF THE INVENTION

In one aspect, a gaming method includes receiving a wager from a first player, displaying an image representative of a game, determining an outcome for the game represented by the image, and associating a first payout with the first player according to the outcome. The method also includes receiving an exchange of communications between the first player and a second player regarding an exchange of the first payout and a second payout, associating the second payout with the first player, and associating the first payout with the second player.

In another aspect, a gaming system includes a gaming apparatus and a payout exchange computer. The gaming apparatus may include a value input device, a display unit, and a controller having a processor and a memory, the controller operatively coupled to the value input device and the display device. The controller may be programmed to receive a wager from a first player via the value input device, to cause the display unit to generate an image representative of a game, to determine an outcome for the game represented by the image, and to associate a first payout with the first player according to the outcome. The payout exchange computer may have a processor and memory. The payout exchange computer may be programmed to receive an exchange of communications between the first player and a second player regarding an exchange of the first payout and a second payout, to associate the second payout with the first player, and to associate the first payout with the second player.

Additional aspects of the disclosure are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
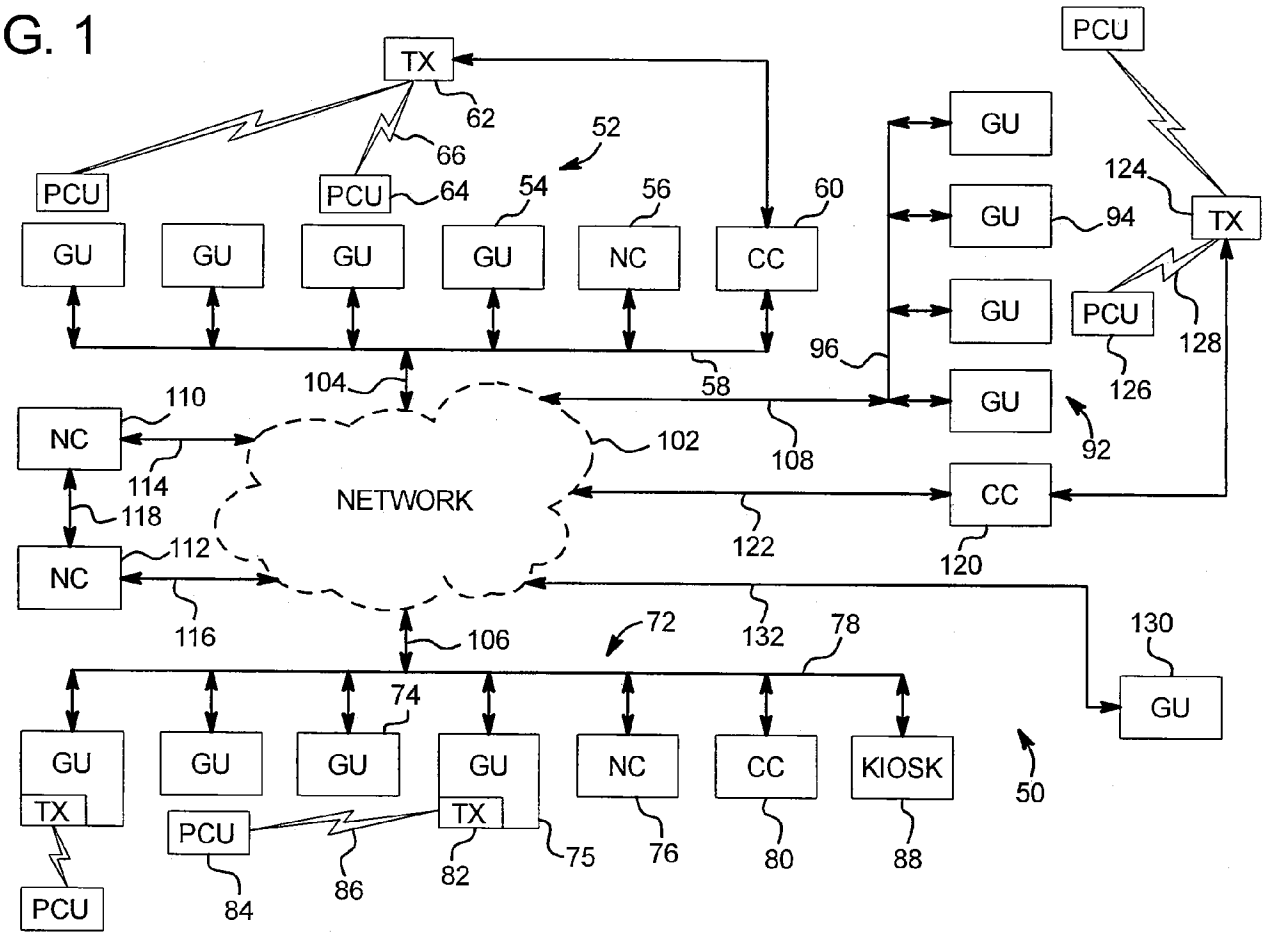
FIG. 1 is a block diagram of an embodiment of a gaming and payout exchange system in accordance with the disclosure.

FIG. 1 illustrates one possible embodiment of a casino gaming and payout exchange system 50 (hereinafter "system 50") in accordance with the disclosure. Referring to FIG. 1, the system 50 may include a first group or network 52 of casino gaming units 54 operatively coupled to a network computer 56 via a network data link or a bus 58. The first network 52 may also include a communications computer 60, which may be coupled to the network computer 56 via the data link or bus 58. The communications computer 60 may also be coupled to a transceiver 62, which transceiver may be a wireless transceiver, such as a radio frequency transceiver or infrared transceiver, for example. The transceiver 62 may be in communication with one or more personal communication units 64 (such as a Personal Digital Assistant or the like, having a controller including a processor and memory operatively coupled to the processor), a data link 66 being formed according to the method of communication used (e.g., radio frequency, infrared, etc.). The personal communication units 64 may be owned by the player, or may be provided to the player by the operator of the network 52.

The system 50 may include a second group or network 72 of casino gaming units 74, 75 operatively coupled to a network computer 76 via a network data link or a bus 78. The second network 72 may also include a communications computer 80, which may be coupled to the network computer 76 via the data link or bus 78. The communications computer 80 may also be coupled via the data link or bus 78 to transceivers 82 that are attached to or integrated with the gaming units 75, which transceivers may be wireless transceivers, such as a radio frequency transceivers or infrared transceivers, for example. The transceivers 82 may be in communication with one or more personal communication units 84, a data link 86 being formed according to the method of communication used (e.g., radio frequency, infrared, etc.). The personal communication units 84 may be owned by the player, or may be provided to the player by the operator of the network 72. Furthermore, a kiosk 88 may be coupled to the data link 78, and may represent an apparatus that is not intended to operate a part of the gaming aspect of the system 50, but may operate as part of another aspect of the system 50, such as the payout exchange aspect of the system 50, as explained in greater detail below.

The system 50 may further include a third group or network 92 of casino gaming units 94. The gaming units 94 may be coupled via a data link or a bus 96. The third network 92 differs from the first and second networks in that there is no network computer coupled to the data link 96.

The first, second, and third gaming networks 52, 72, 92 may be operatively coupled to each other via a fourth network 102, which may comprise, for example, the Internet, an intranet, a wide area network (WAN), or a local area network (LAN). The network 102 may include a plurality of network computers or server computers (not shown), each of which may be operatively interconnected. The first, second and third networks 52, 72, 92 may be coupled to the fourth network 102 via a first, second, and third data links 104, 106, 108. Where the network 102 comprises an Intranet or the Internet, data communication may take place over the communication links 104, 106, 108 via an Internet communication protocol.

The fourth network 102 may also be coupled to other computers or networks other than the first, second and third networks 52, 72, 92 discussed above. For example, the fourth network may be coupled to one or more other network computers 110, 112 via data links 114, 116. These network computers 110, 112 may, in turn, be coupled via data links 118. Additionally, the fourth network may be coupled to a communications computer 120 via a data link 122, the communications computer being coupled to a transceiver 124. The transceiver 124 is shown in communication with personal communication units 126, which may be in the same geographic location as the gaming units 94 of the network 92, via a data link 128 formed according to the method of communication used (e.g. radio frequency, infrared, etc.). The personal communication units 126 may be owned by the player, or may be provided to the player by the operator of the network 92. Further, a gaming unit 130 may be coupled to the fourth network 102 via a data link 132, and may represent an individual gaming unit unassociated with one of the other networks 52, 72, 92.

The network computer 56 may be a server. According to one embodiment, the network computer 56 may be used as an accounting system server to accumulate and analyze data relating to the operation of the gaming units 54. For example, the network computer 56 may continuously receive data from each of the gaming units 54 indicative of the dollar amount and number of wagers being made on each of the gaming units 54, data indicative of how much each of the gaming units 54 is paying out in winnings, etc. According to another embodiment, the network computer 56 may be used as a player tracking server or a bonusing server to accumulate and analyze data relating to the operation of particular gaming units 54. According to this embodiment, the network computer 56 may receive data from a particular gaming unit 54 indicative of the identity of the player operating the gaming unit 54, the number of wagers being made on the gaming unit 54, etc. If the network computer 56 is being used as a player tracking server, the network computer 56 may use the data accumulated to award player tracking points to the player, which points may be used to assess comps or to be redeemed for goods or services. If the network computer is being used as a bonusing computer, the network computer 56 may use the data accumulated to award the player prizes, which may be goods or services, based on individual or collective performance, to award bonusing points which points may be redeemed for goods or services, etc. According to a still further embodiment, the network computer 56 may be used as a download server to monitor the software implemented by and the data utilized by the gaming units 54, to determine if software or data upgrades are available, and to download the upgrades to the gaming units 54. According to yet another embodiment, the network computer 56 may be used as a payout exchange server, as will be explained in greater detail below.

The network computer 76 may be a server and may be used to perform the same or different functions in relation to the gaming units 74, 75 as the network computer 56 described above. Similarly, the network computers 110, 112 may be servers, and may be used to perform the same or different functions in relation to the gaming units 54, 74, 75, 94 as the network computers 56, 76. Moreover, the network computers 110, 112 may be different servers, and may perform the same or different functions in relation to the gaming units 54, 74, 75, 94.

As an alternative, the operation of the gaming units may be monitored and/or coordinated without the use of a central computer or controller, as in the third network 92. During operation, the processing required by the operations otherwise performed by a network computer may be shared by the gaming units 94. Such shared processing may be referred to as peer-to-peer networking, and is also within the scope of the present disclosure.

The communications computers 60, 80 may also be servers. That is, the computers 60, 80 may monitor and coordinate the communications between other computers, such as the network computers 56, 76, and the personal communication units 64, 84 via the transceivers 62, 82. Alternatively, as in the case of the communications computer 120, the communications computer may be part of a mobile communications network that is operated and administered by an entity other than the entity that operates and administers the network of gaming units, such as gaming units 94. Such a mobile communications network may be a cellular telephone network, and the communications computer 120 may represent the base station system of such a network, which base station system may be in communication with the Internet via a gateway, for example. According to this embodiment, the personal communication units 126 may be mobile stations, such as cellular telephones, portable e-mail devices (e.g. BLACKBERRY® devices manufactured by Research In Motion Ltd., of Waterloo, Ontario, Canada), personal digital assistants (PDA), laptops, tablet personal computers, etc.

The first network 52 of gaming units 54 may be provided in a first casino, the second network 72 of gaming units 74 may be provided in a second casino located in a separate geographic location than the first casino, and the third network 92 of gaming units 94 may be provided in a third casino in a separate geographic location that the first and the second networks. For example, the three casinos may be located in different areas of the same city, or they may be located in different states. However, the three networks 52, 72, 92 may be disposed in different sections of the same casino, or the gaming units 54, 74, 75, and 94 may even be disposed in the same section of the same casino.

Although the networks 52, 72 are shown as including one network computer 56, 76, one communications computer 60, 80, and four gaming units 54, 64 and the network 92 as including four gaming units 94, it should be understood that different numbers of computers and gaming units may be utilized. For example, the network 52 may include a plurality of network computers 56 and tens or hundreds of gaming units 54, all of which may be interconnected via the data link 58. The data link 58 may be provided as a dedicated hardwired link, a wireless link, a fiber optic link, or a network (LAN, WAN, Internet, intranet) connection. Although the data link 58 is shown as a single data link 58, the data link 58 may comprise multiple data links. Numerous kiosks 88 may also be included in a network, such as the network 72, although only one kiosk 88 is shown. Similarly, there may be a plurality of gaming units 130 and personal communication units 64, 84, 126.

Figure 2:
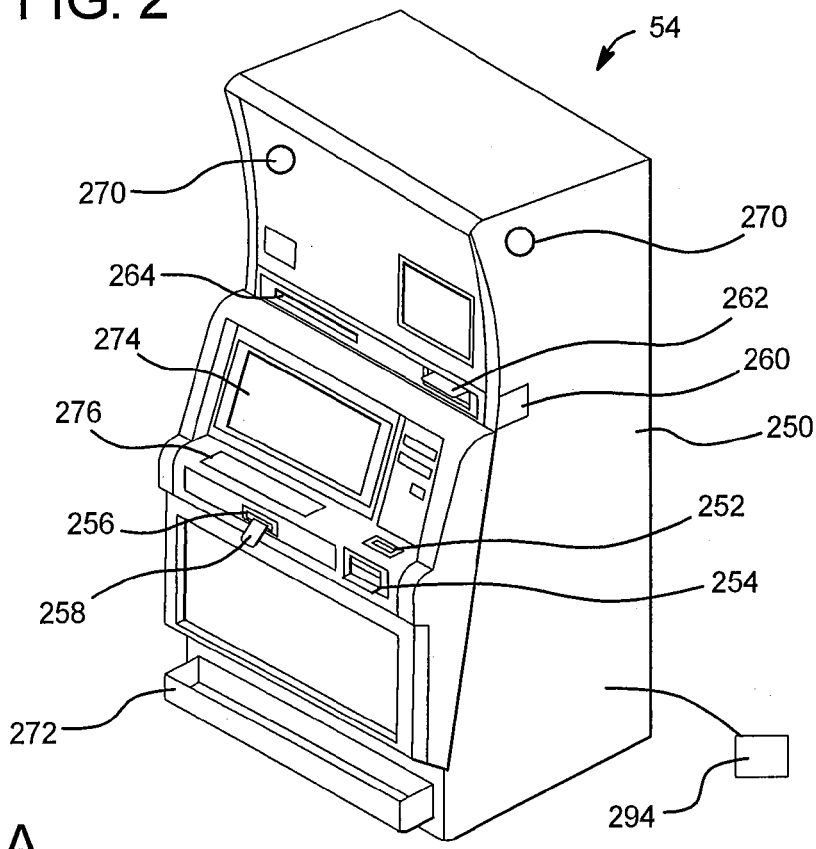
FIG. 2 is a perspective view of an embodiment of one of the gaming units shown schematically in FIG. 1.

FIG. 2 is a perspective view of one possible embodiment of one or more of the gaming units 54. Although the following description addresses the design of the gaming units 54, it should be understood that the gaming units 74, 75, 94 may have the same design as the gaming units 54 described below. It should be understood that the design of one or more of the gaming units 54 may be different than the design of other gaming units 54, and that the design of one or more of the gaming units 74, 75, 94 may be different than the design of other gaming units 74, 75, 94. Each gaming unit 54 may be any type of casino gaming unit and may have various different structures and methods of operation. For exemplary purposes, various designs of the gaming units 54 (and 75) are described below, but it should be understood that numerous other designs may be utilized.

Referring to FIG. 2, the casino gaming unit 54 may include a housing or cabinet 250 and one or more value input devices, which may include a coin slot or acceptor 252, a paper currency acceptor 254, and a ticket reader/printer 256. The value input device may also be a card reader (not shown). A value input device may include any device that can accept value from or transfer value for a player, and may be disposed on the front of the gaming unit 54 or in any other suitable location. As used herein, the term "value" may encompass money denominations or credits, and may be in the form of coins, paper currency, gaming tokens, ticket vouchers, credit or debit cards, smart cards, electronic funds transfers (EFT) and any other object representative of value.

Some of the value input devices may also operate as value output devices. For example, if provided on the gaming unit 54, the ticket reader/printer 256 may be used to print or otherwise encode ticket vouchers 258. The ticket vouchers 258 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 258 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 258 could be printed with an optically readable material such as ink, or data on the ticket vouchers 258 could be magnetically encoded. The ticket reader/printer 256 may be provided with the ability to both read and print ticket vouchers 258, or it may be provided with the ability to only read or only print or encode ticket vouchers 258. In the latter case, for example, some of the gaming units 54 may have ticket printers 256 that may be used to print ticket vouchers 258, which could then be used by a player in other gaming units 54 that have ticket readers 256.

As another alternative, an electronic funds transfer (EFT) device (not shown) may operate as both a value input device and a value output device. Such an EFT device may include a circuit capable of performing or a controller programmed to perform an electronic funds transfer (EFT) to the player's bank account or to a virtual account established, for example, on a PDA or at a casino. Such a transfer may be performed over a hardwired, wireless, fiber optic or network connection. As such a device is capable of transferring money to and from the gaming unit 54, it may operate either as a value input device or a value output device.

Also attached to the gaming unit 54 is a player tracking module 260. The player tracking module 260 includes a card reader 262 and a display 264. The card reader 262 may include any type of card reading device, such as a magnetic card reader or an optical card reader, and may be used to read data from a card offered by a player, such as a player tracking card. The card reader 262 may be used to read data from, and/or write data to, player tracking cards that are capable of storing data representing the identity of a player, the identity of a casino, the player's gaming habits, etc. The display 264 may be a vacuum fluorescent display (VFD), a liquid crystal display (LCD), an array of LED elements, etc. The display 264 may be used to display messages particular to the player tracking system, or may be controlled by the gaming unit 54 or other servers to display messages particular to the operation of the gaming unit 54 or other systems (such as, for example, bonusing messages from a bonusing system).

The gaming unit 54 may include one or more audio speakers 270, a coin payout tray 272, a display unit 274, and an input control panel 276. The audio speakers 270 may generate audio representing sounds such as the noise of spinning slot machine reels, a dealer's voice, music, announcements or any other audio related to a casino game. Where the gaming unit 54 is designed to facilitate play of a video casino game, such as video poker or video slots, the display unit 274 may be a color video display unit that displays images relating to the particular game or games. Where the gaming unit 54 is designed to facilitate play of a reel-type slot machine, the display unit 274 may comprise a plurality of mechanical reels that are rotatable, with each of the reels having a plurality of reel images disposed thereon. The input control panel 276 may be provided with a plurality of pushbuttons or touch-sensitive areas that may be pressed by a player to select games, make wagers, make gaming decisions, etc.

Figure 2A:
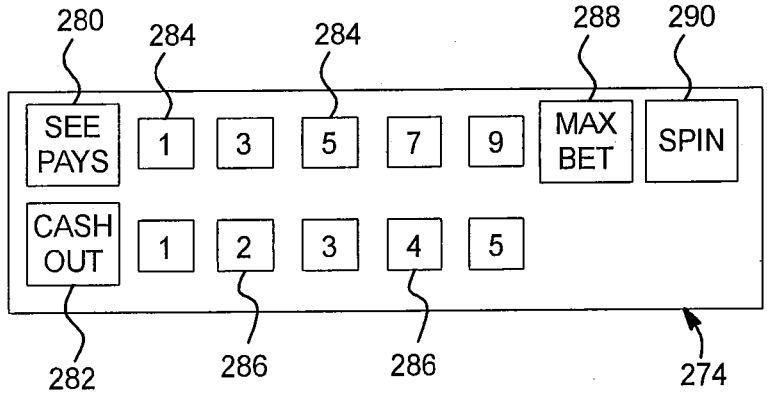
FIG. 2A illustrates an embodiment of a control panel for a gaming unit.

FIG. 2A illustrates one possible embodiment of the control panel 276, which may be used where the gaming unit 54 is a slot machine having a plurality of mechanical, electromechanical or electronic (i.e., as represented on a video display unit) reels. Referring to FIG. 2A, if the display unit 274 is provided in the form of a video display unit, the control panel 276 may include a "See Pays" button 280 that, when activated, causes the display unit 274 to generate one or more display screens showing the odds or payout information for the game or games provided by the gaming unit 54. As used herein, the term "button" is intended to encompass any device that allows a player to make an input, such as an input device that must be depressed to make an input selection or a display area that a player may simply touch. The control panel 276 may include a "Cash Out" button 282 that may be activated when a player decides to terminate play on the gaming unit 54, in which case the gaming unit 54 may return value to the player, such as by returning a number of coins to the player via the payout tray 272.

If the gaming unit 54 provides a slots game having a plurality of reels and a plurality of paylines which define winning combinations of reel symbols, the control panel 276 may be provided with a plurality of selection buttons 284, each of which allows the player to select a different number of paylines prior to spinning the reels. For example, five buttons 284 may be provided, each of which may allow a player to select one, three, five, seven or nine paylines.

If the gaming unit 54 provides a slots game having a plurality of reels, the control panel 276 may be provided with a plurality of selection buttons 286 each of which allows a player to specify a wager amount for each payline selected. For example, if the smallest wager accepted by the gaming unit 54 is a quarter ($0.25), the gaming unit 54 may be provided with five selection buttons 286, each of which may allow a player to select one, two, three, four or five quarters to wager for each payline selected. In that case, if a player were to activate the "5" button 284 (meaning that five paylines were to be played on the next spin of the reels) and then activate the "3" button 286 (meaning that three coins per payline were to be wagered), the total wager would be $3.75 (assuming the minimum bet was $0.25).

The control panel 276 may include a "Max Bet" button 288 to allow a player to make the maximum wager allowable for a game. In the above example, where up to nine paylines were provided and up to five quarters could be wagered for each payline selected, the maximum wager would be 45 quarters, or $11.25. The control panel 276 may include a spin button 290 to allow the player to initiate spinning the reels of a slots game after a wager has been made.

In FIG. 2A, a rectangle is shown around the buttons 280, 282, 284, 286, 288, 290. It should be understood that that rectangle simply designates, for ease of reference, an area in which the buttons 280, 282, 284, 286, 288, 290 may be located. Consequently, the term "control panel" should not be construed to imply that a panel or plate separate from the housing 250 of the gaming unit 54 is required, and the term "control panel" may encompass a plurality or grouping of player activatable buttons.

Although one possible control panel 276 is described above, it should be understood that different buttons could be utilized in the control panel 276, and that the particular buttons used may depend on the game or games that could be played on the gaming unit 54. If the display unit 274 is provided as a video display unit, the control panel 276 could be generated by the display unit 274. In that case, each of the buttons of the control panel 276 could be a colored area generated by the display unit 274, and some type of mechanism may be associated with the display unit 274 to detect when each of the buttons was touched, such as a touch-sensitive screen.

The gaming unit 54 may also include a mechanism 294 by which the gaming unit 54 may determine the identity of the player. This mechanism may be separate from the other elements of the gaming unit 54, may be incorporated into one of the other elements of the gaming unit 54, or its function may be provided by one of the other elements of the gaming unit 54. As an example of the latter category, the card reader 262 may be used to read a card that carries an identification code that may be uniquely associated with the player so that the gaming unit 54 can differentiate that player from all other players, or so that the gaming unit 54 can differentiate that player as a member of a group of players from all players not a member of the group of players. In FIG. 2, a separate identification device 294 is illustrated.

The identification device 294 may include equipment, such as a keypad, an input pad (with optional stylus), a port (or antenna) adapted to communicate via a wired or wireless link (infrared or radio frequency link, for example) to a Personal Digital Assistant (PDA), a camera, a scanner, a retinal (or iris) scanner, fingerprint scanner, and/or a microphone. The identification device 294 may include any one of these devices, or the identification device 294 may include a combination of some or all of these devices. Thus, utilizing the identification device 294, a player may identify him or herself by entering a unique numeric or alpha-numeric code using the key pad, for example. Alternatively, the player may use his or her finger or the stylus to sign his or her signature on the input pad. The pad and/or stylus may include instrumentation to record such characteristics as position, form, speed, and/or pressure as the player signs his or her signature. As a further alternative, the player may sign his or her signature on the Personal Digital Assistant, which signature is then converted to electronic data, and the data is then transferred via the port/antenna to the identification device 294. As yet another alternative, the player may sign his or her signature on a piece of paper that is then photographed using the camera or scanned using the scanner (or the bill acceptor 254) to convert the signature into electronic data. As an additional alternative, the player may place one of his or her fingers or his or her hand on the scanner, and the scanner may generate an electronic data representation of the fingerprint on one or more of the player's fingers or an electronic data representation of the pattern of the entire hand. Alternatively, the camera may be used to take a picture (live or still) of the player, the picture then being converted into electronic data. As a still further alternative, the player may place his or her eye up to the retinal (or iris) scanner, and the retinal (or iris) scanner may generate an electronic data representation corresponding to the pattern of the retina (or iris) of the player. As yet another alternative, the player may speak into the microphone, and characteristics of the spoken words (or voiceprint) may be converted into an electronic data representation.

Other equipment may also be used in conjunction with the identification device 294. For example, rather than using a stylus, a mouse or glove may be used. Additionally, thermal imaging equipment may be included or substituted. Moreover, a touchscreen may be integrated with the display unit 274 and used, in place of the input pad, in combination with a stylus or a finger, for example.

Gaming Unit Electronics

Figure 3:
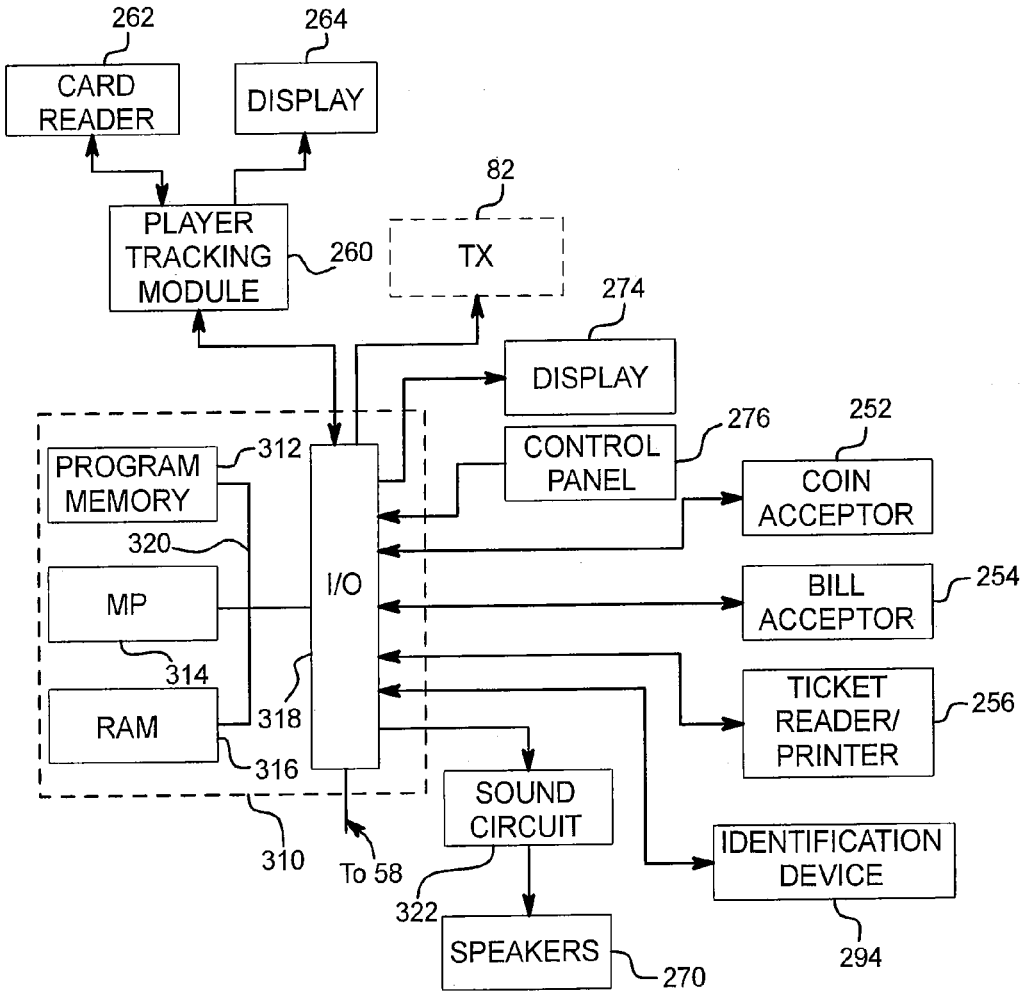
FIG. 3 is a block diagram of the electronic components of the gaming unit of FIG. 2.

FIG. 3 is a block diagram of a number of components that may be incorporated in the gaming unit 54. Referring to FIG. 3, the gaming unit 54 may include a controller 310 that may comprise a program memory 312, a microcontroller or microprocessor (MP) 314, a random-access memory (RAM) 316 and an input/output (I/O) circuit 318, all of which may be interconnected via an address/data bus 320. It should be appreciated that although only one microprocessor 314 is shown, the controller 310 may include multiple microprocessors 314. Similarly, the memory of the controller 310 may include multiple RAMs 316 and multiple program memories 312. Although the I/O circuit 318 is shown as a single block, it should be appreciated that the I/O circuit 318 may include a number of different types of I/O circuits. The RAM(s) 316 and program memories 312 may be implemented as semiconductor memories, magnetically readable memories, and/or optically readable memories, for example.

Although the program memory 312 is shown in FIG. 3 as a read-only memory (ROM) 312, the program memory of the controller 310 may be a read/write or alterable memory, such as a hard disk. In the event a hard disk is used as a program memory, the address/data bus 320 shown schematically in FIG. 3 may comprise multiple address/data buses, which may be of different types, and there may be an I/O circuit disposed between the address/data buses.

Furthermore, while the controller 310 is shown as a dashed box surrounding the memories 312, 316, processor 314, and I/O circuit 318, this should not be interpreted as a physical limitation on the controller 310. The memories 312, 316 and processor 314 may be disposed on a single board, or they may be disposed on separate boards. Similarly, the I/O circuit 318 may be disposed on the same board as the memories 312, 316 and processor 314, or may be disposed on a separate board.

FIG. 3 illustrates that the coin acceptor 252, the bill acceptor 254, the ticket reader/printer 256, the player tracking module 260, the display unit 274, the control panel 276, and the identification device 294 may be operatively coupled to the I/O circuit 318, each of those components being so coupled by either a unidirectional or bidirectional, single-line or multiple-line data link, which may depend on the design of the component that is used. The speaker(s) 270 may be operatively coupled to a sound circuit 322, that may comprise a voice- and sound-synthesis circuit or that may comprise a driver circuit. The sound-generating circuit 322 may be coupled to the I/O circuit 318. Additionally, for a gaming unit such as the gaming unit 75, the transceiver 82 may also be coupled to the I/O circuit 318.

As shown in FIG. 3, the components 252, 254, 256, 260, 274, 276, 294, 322 (and, optionally, 82) may be connected to the I/O circuit 318 via a respective direct line or conductor. Different connection schemes could be used. For example, one or more of the components shown in FIG. 3 may be connected to the I/O circuit 318 via a common bus or other data link that is shared by a number of components. Furthermore, some of the components may be directly connected to the microprocessor 314 without passing through the I/O circuit 318.

Overall Operation of System

One manner in which the system 50 and one or more of the gaming units 54 (and one or more of the gaming units 74, 75, 94) may operate is described below in connection with a number of flowcharts which may be implemented as a number of portions or routines of one or more computer programs. These programs or portions of programs may be represented as a set of instructions that may be carried out by one or more of the network computers 56, 76, 110, 112 and/or the controller 310 of gaming units 54, 74, 75, 94, for example.

The programs or portions of programs may be written in any high level language such as C, C++, C#, Java, Visual Basic or the like, or any low-level assembly or machine language. The programs or portions of programs may include data files, binary files, scripts, data tables, graphic file formats, 3D models, etc. Furthermore, the programs or portions of programs may be implemented using an event-based triggering system. That is, the controller 310, for example, may generate an event (for example, in connection with a game outcome) that is in turn communicated to the display unit 274, the sound circuit 322, and a payout device, for example, the ticket reader/printer 256. Each unit or device may then determine if the communicated event has significance for that unit or device, and what that significance may be. As a result, units or device may be added or removed from the gaming unit 54 without requiring significant reprogramming of the controller 310, thereby permitting a modular approach to be implemented.

It will also be recognized that the programs or portions of programs may be stored on a machine accessible medium. A machine accessible medium includes any mechanism that provides (i.e., stores and/or transmits) information in a form accessible by a machine (e.g., a computer, network device, personal digital assistant, any device with a set of one or more processors, etc.). For example, a machine accessible medium includes recordable/non-recordable magnetic, optical and solid-state media (e.g., read only memory (ROM), programmable read only memory (PROM), erasable programmable read only memory (EPROM), electrically erasable programmable read only memory (EEPROM), random access memory (RAM), magnetic disk storage media, optical storage media, flash memory devices, etc.), as well as electrical, optical, acoustical or other form of propagated signals (e.g., carrier waves, infrared signals, digital signals, etc.), etc. According to the present embodiment, the machine-accessible medium may include the memories associated with the network computers 56, 76, 110, 112 and the memories 312, 316 of the controller 310.

In regard to the gaming units 54 (and gaming units 74, 75, 94), the programs or portions of programs may be stored remotely, outside of the gaming unit 54, and may control the operation of the gaming unit 54 from a remote location. Such remote control may be facilitated with the use of a wireless connection, or by an Internet interface that connects the gaming unit 54 with a remote computer (such as the network computer 56) having a memory in which the computer program portions are stored. By storing the programs or portions of programs therein, various portions of the memories are physically and/or structurally configured in accordance with the instructions of the programs or portions of programs.

Main Gaming Routine

Figure 4:
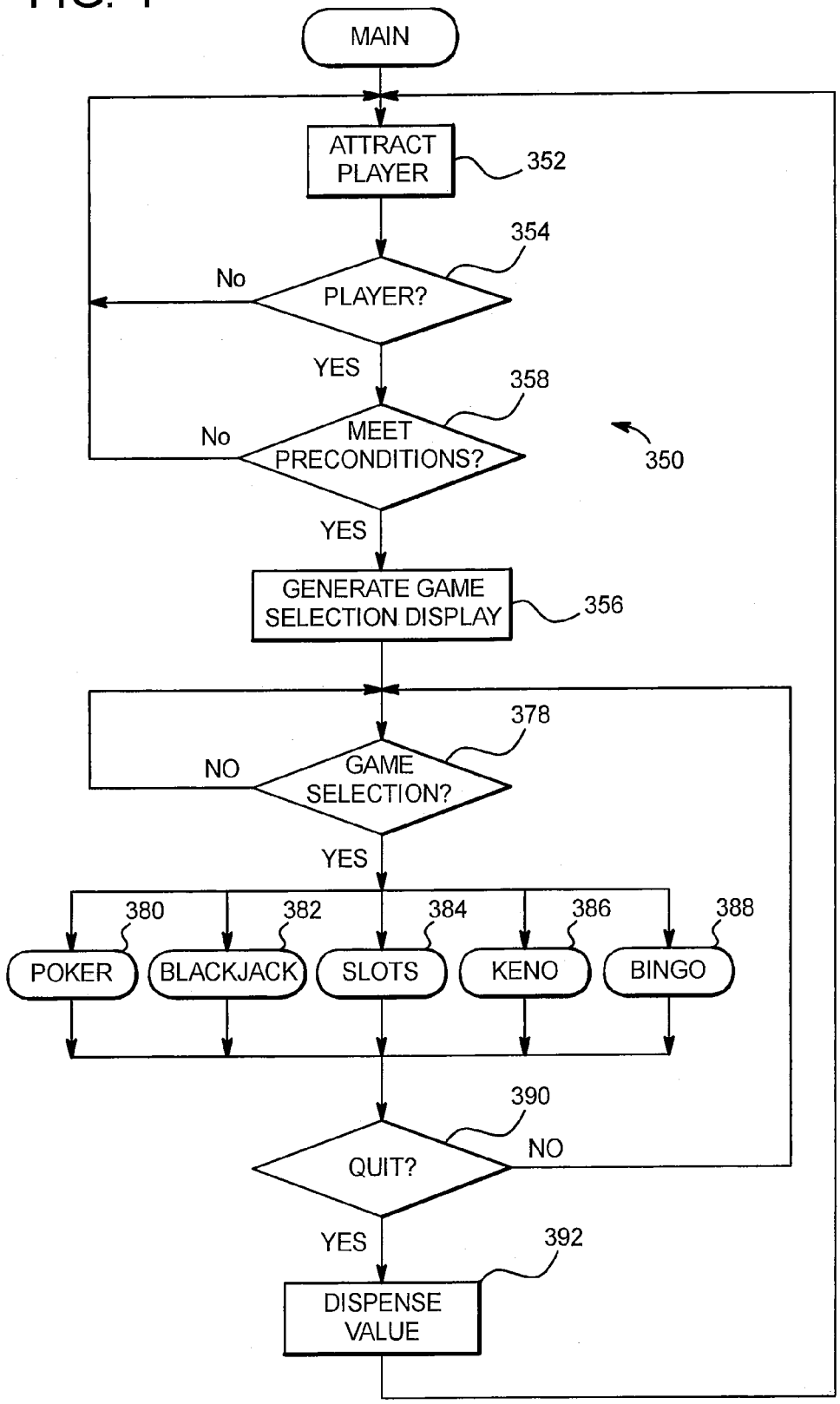
FIG. 4 is a flowchart of an embodiment of a main gaming routine that may be performed during operation of one or more of the gaming units.

FIG. 4 is a flowchart of a gaming main operating routine 350 that may be stored in the memory of the controller 310. Referring to FIG. 4, the main routine 350 may begin operation at block 352 during which an attraction sequence may be performed in an attempt to induce a potential player in a casino to play the gaming unit 54. The attraction sequence may be performed by displaying one or more video images on the display unit 274 (if provided as a video display unit) and/or causing one or more sound segments, such as voice or music, to be generated via the speakers 270. The attraction sequence may include a scrolling list of games that may be played on the gaming unit 54 and/or video images of various games being played, such as video poker, video blackjack, video slots, video keno, video bingo, etc.

During performance of the attraction sequence, if a potential player makes any input to the gaming unit 54 as determined at block 354, the attraction sequence may be terminated. The gaming unit 54 may detect an input at block 354 in various ways. For example, the gaming unit 54 could detect if the player presses any button on the gaming unit 54; the gaming unit 54 could determine if the player deposited one or more coins into the gaming unit 54; the gaming unit 54 could determine if player deposited paper currency into the gaming unit; etc.

After terminating the attraction sequence, the routine 350 may proceed to a block 356, and a game-selection display may be generated on the display unit 274 (if provided as a video display unit) to allow the player to select a game available on the gaming unit 54. However, according to certain embodiments of the system 50, the gaming units may be provided at locations remote from the place of business of the operator of the system 50. In such a situation, it may be necessary to ensure that certain preconditions are met before the player is permitted to place a wager and play a game. A block 358 is shown in FIG. 4, and represents a determination as to whether a player has met the preconditions for placing a wager and playing a game. The determination represented by the block 358 in FIG. 4 may be discussed in greater detail with reference to a verification routine 360 in FIG. 5.

Figure 5:
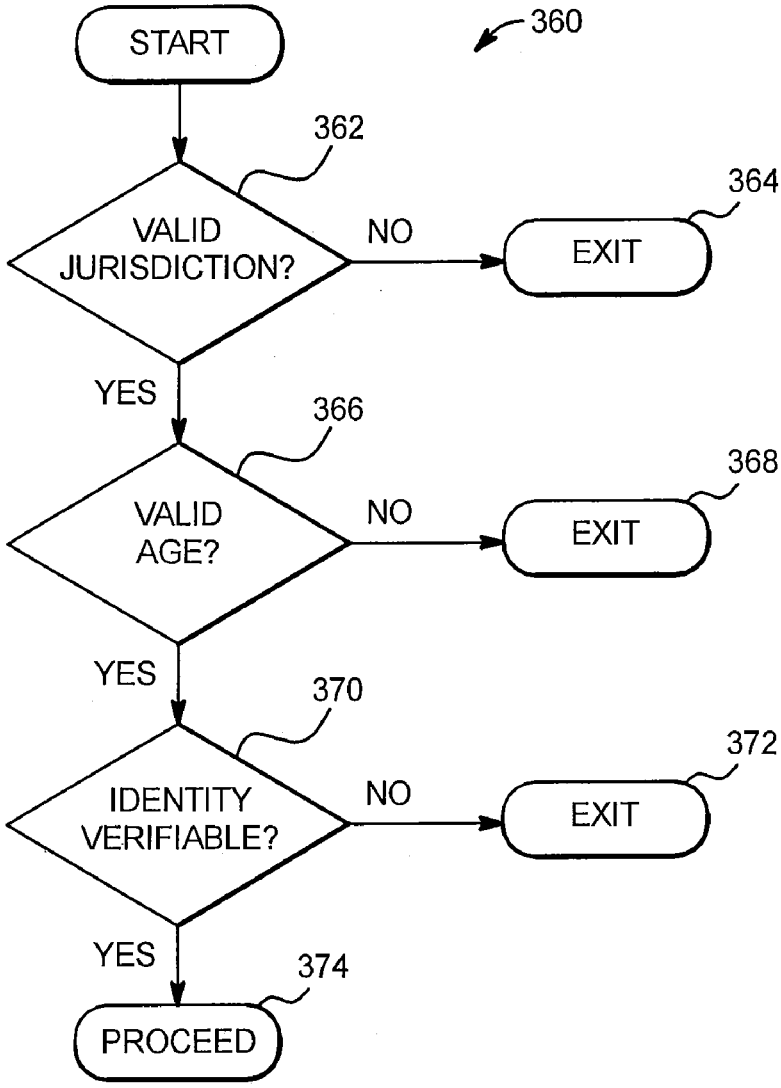
FIG. 5 is a flowchart of an embodiment of a verification routine that may be performed during the operation of the main gaming routine of FIG. 4.

According to FIG. 5, the verification routine 360 begins at a block 362, wherein a determination may be made at to whether the gaming unit (e.g., gaming unit 130) is located in a jurisdiction that permits gaming. As one such embodiment, the gaming unit may be associated with a device that provides location data for the gaming unit that may be transmitted to the gaming system operator. For example, the Global Positioning Satellite (GPS) system may be utilized by associating a special transceiver with the gaming unit. As a further example, the gaming system operator may require the player to connect to the system 50 using a cellular mobile station (or at a minimum to make a call using the mobile station or to turn the cellular mobile station on during play). The gaming system operator may then access the location information available to the cellular system operator after the cellular system operator has processed the cellular transmission data from the mobile station (such as may be done in providing enhanced 911 (or E-911) service, for example). Alternatively, the player may be required to connect to the system 50 from a land line (or to call the gaming system operator using a land line telephone during the verification process), whereupon the gaming system operator may check the telephone company's records to verify the number and pull the street address associated with the number. As a further alternative, where the player has connected to the system 50 over the Internet, the gaming system operator may check the IP address of the gaming unit and of the Internet service provider, and obtain a street address from the Internet service provider. If the determination is made that the gaming unit is not located in a jurisdiction that permits gaming, the routine exits at a block 364, and the routine 350 returns to the block 352; otherwise, routine passes to a block 366.

At the block 366, a determination may be made as to whether the player meets minimum age requirements (set by state gaming agencies, for example) necessary to operate the gaming unit. For example, a registration event at the gaming system operator's place of business, the player may provide proof of age and identity. The data may then be stored in a memory, such as a server operating as a database at the gaming system operator's place of business or a more portable memory device, such as a memory card or a PDA. The age data may be accessed later to prove age qualification by matching (within established standards) the identity data stored with the age data. If the determination is made and the player fails to age qualify, then the routine 360 may exit at block 368, and the routine 350 returns to the block 352; if the player age qualifies or the determination is omitted, then the routine proceeds to block 370.

At the block 370, a determination may be made as to whether the identify of the player can be verified. The determination of block 370 may be omitted where the gaming system operator can limit access by underage players to the gaming units (for example, in a casino-type gaming environment as opposed to an Internet-type gaming environment). However, the system operator may require that the player provide a form of identification (such as a fingerprint or other form of biometric data, driver's license, or national identity card) that the gaming system operator may use to access age data established by a third party (for example, the state department of motor vehicles). As an alternative, a camera associated with the gaming unit may be used to monitor the player using the gaming unit to verify identity. If the player fails to provide or is unwilling to provide proper verification of identify, the routine 370 exits at a block 372 and the routine 350 returns to the block 352; alternatively, the routine 360 passes to a block 374, and the routine 350 passes to the block 356.

The game-selection display generated at block 356 may include, for example, a list of video games that may be played on the gaming unit 54 and/or a visual message to prompt the player to deposit value into the gaming unit 54. While the game-selection display is generated, the gaming unit 54 may wait for the player to make a game selection. Upon selection of one of the games by the player as determined at block 378, the controller 310 may cause one of a number of game routines to be performed to allow the selected game to be played. For example, the game routines could include a video poker routine 380, a video blackjack routine 382, a slots routine 384, a video keno routine 386, and a video bingo routine 388. At block 378, if no game selection is made within a given period of time, the operation may branch back to block 352.

After one of the routines 380, 382, 384, 386, 388 has been performed to allow the player to play one of the games, block 390 may be utilized to determine whether the player wishes to terminate play on the gaming unit 54 or to select another game. If the player wishes to stop playing the gaming unit 54, which wish may be expressed, for example, by selecting a "Cash Out" button, the controller 310 may dispense value to the player at block 392 based on the outcome of the game(s) played by the player. The operation may then return to block 352. If the player did not wish to quit as determined at block 390, the routine may return to block 356 where the game-selection display may again be generated to allow the player to select another game.

It should be noted that although five gaming routines are shown in FIG. 4, a different number of routines could be included to allow play of a different number of games. The gaming unit 54 may also be programmed to allow play of different games.

Figure 6:
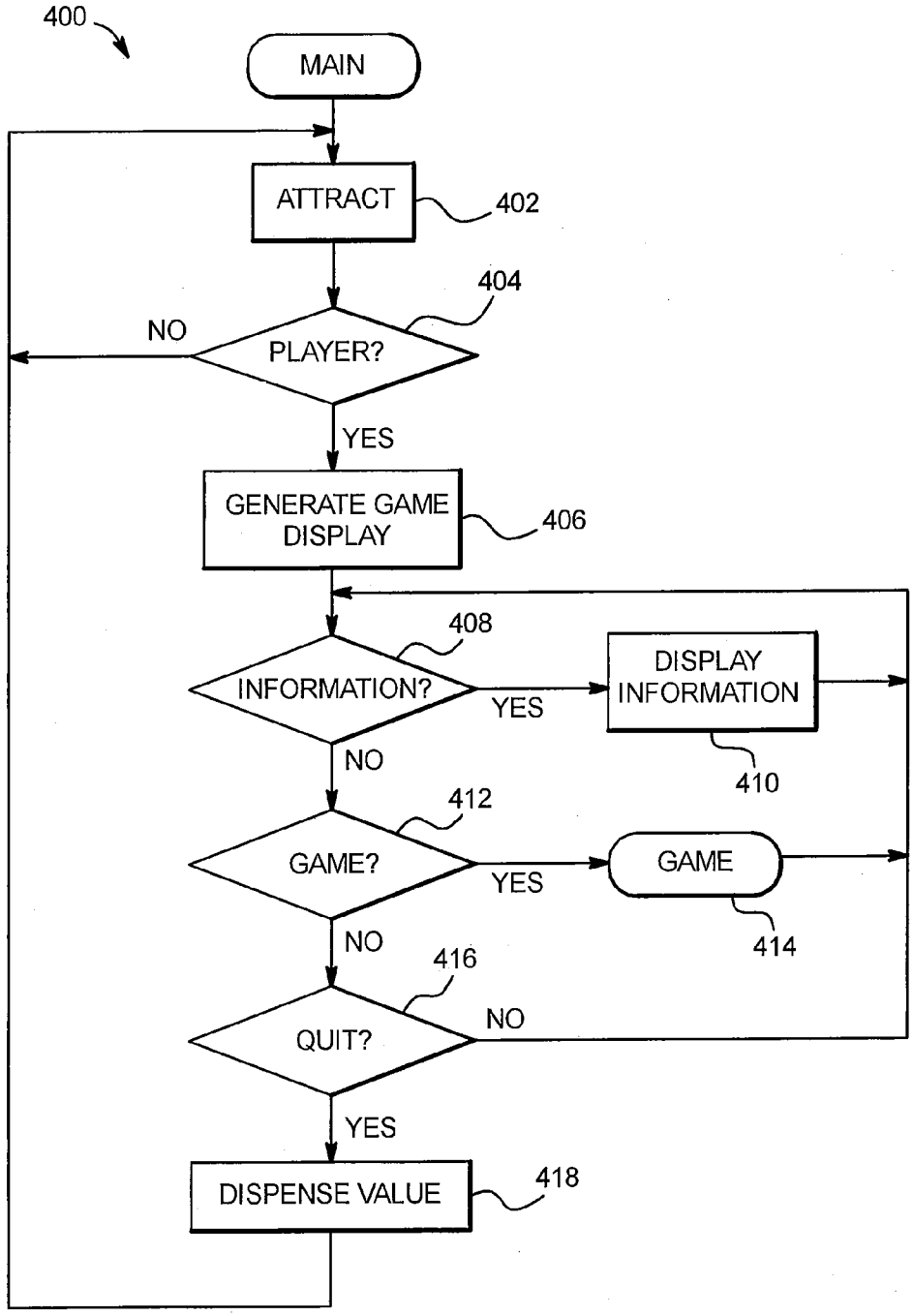
FIG. 6 is a flowchart of an alternative embodiment of a main gaming routine that may be performed during operation of one or more of the gaming units.

FIG. 6 is a flowchart of an alternative main operating routine 400 that may be stored in the memory of the controller 310. The main routine 400 may be utilized for gaming units 54 that are designed to allow play of only a single game or single type of game, and does not include the preconditions block shown in the routine of FIG. 4, although the routine of FIG. 6 may be altered to include such block. Referring to FIG. 6, the main routine 400 may begin operation at block 402 during which an attraction sequence may be performed in an attempt to induce a potential player in a casino to play the gaming unit 54. The attraction sequence may be performed by displaying one or more video images on the display unit 274 (if provided as a video display unit) and/or causing one or more sound segments, such as voice or music, to be generated via the speakers 270.

During performance of the attraction sequence, if a potential player makes any input to the gaming unit 54 as determined at block 404, the attraction sequence may be terminated and a game display may be generated on the display unit 274 (if provided as a video display unit) at block 406. The game display generated at block 406 may include, for example, an image of the casino game that may be played on the gaming unit 54 and/or a visual message to prompt the player to deposit value into the gaming unit 54. At block 408, the gaming unit 54 may determine if the player requested information concerning the game, in which case the requested information may be displayed at block 410. Block 412 may be used to determine if the player requested initiation of a game, in which case a game routine 414 may be performed. The game routine 414 could be any one of the game routines disclosed herein, such as one of the five game routines 380, 382, 384, 386, 388, or another game routine.

After the routine 414 has been performed to allow the player to play the game, block 416 may be utilized to determine whether the player wishes to terminate play on the gaming unit 54. If the player wishes to stop playing the gaming unit 54, which wish may be expressed, for example, by selecting a "Cash Out" button, the controller 310 may dispense value to the player at block 418 based on the outcome of the game(s) played by the player. The operation may then return to block 402. If the player did not wish to quit as determined at block 416, the operation may return to block 406.

Figure 7:
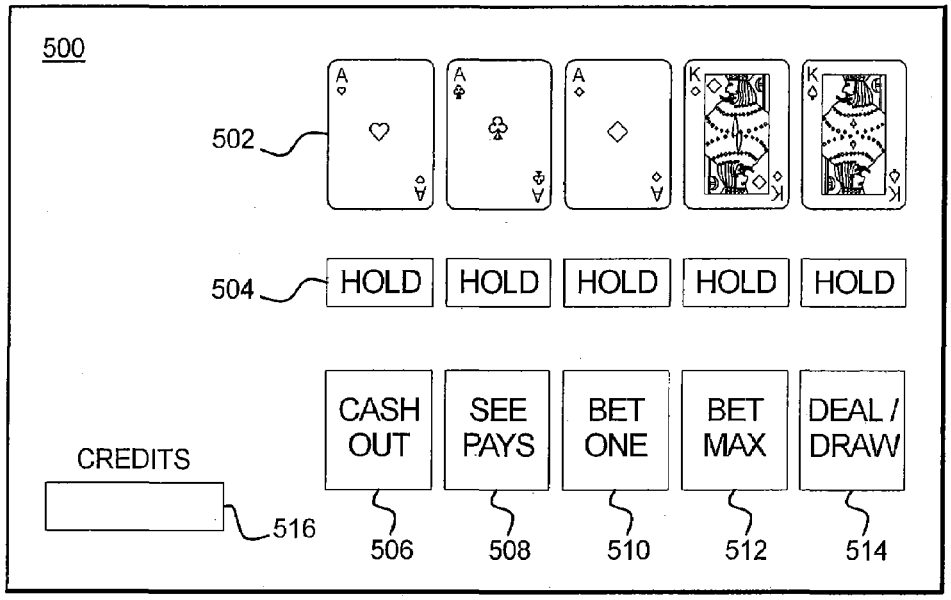
FIG. 7 is an illustration of an embodiment of a visual display that may be displayed during performance of the video poker routine of FIG. 9.

Video Poker

Where the gaming unit 54 is designed to facilitate play of a video poker game, the display unit 274 may comprise a video display unit. FIG. 7 is an exemplary display 500 that may be shown on the display unit 274 during performance of the video poker routine 380 shown schematically in FIG. 4. Referring to FIG. 7, the display 500 may include video images 502 of a plurality of playing cards representing the player's hand, such as five cards. To allow the player to control the play of the video poker game, a plurality of player-selectable buttons may be displayed. The buttons may include a "Hold" button 504 disposed directly below each of the playing card images 502, a "Cash Out" button 506, a "See Pays" button 508, a "Bet One Credit" button 510, a "Bet Max Credits" button 512, and a "Deal/Draw" button 514. The display 500 may also include an area 516 in which the number of remaining credits or value is displayed. If the display unit 274 is provided with a touch-sensitive screen, the buttons 504, 506, 508, 510, 512, 514 may form part of the video display 500. Alternatively, one or more of those buttons may be provided as part of a control panel that is provided separately from the display unit 274.

Figure 9:
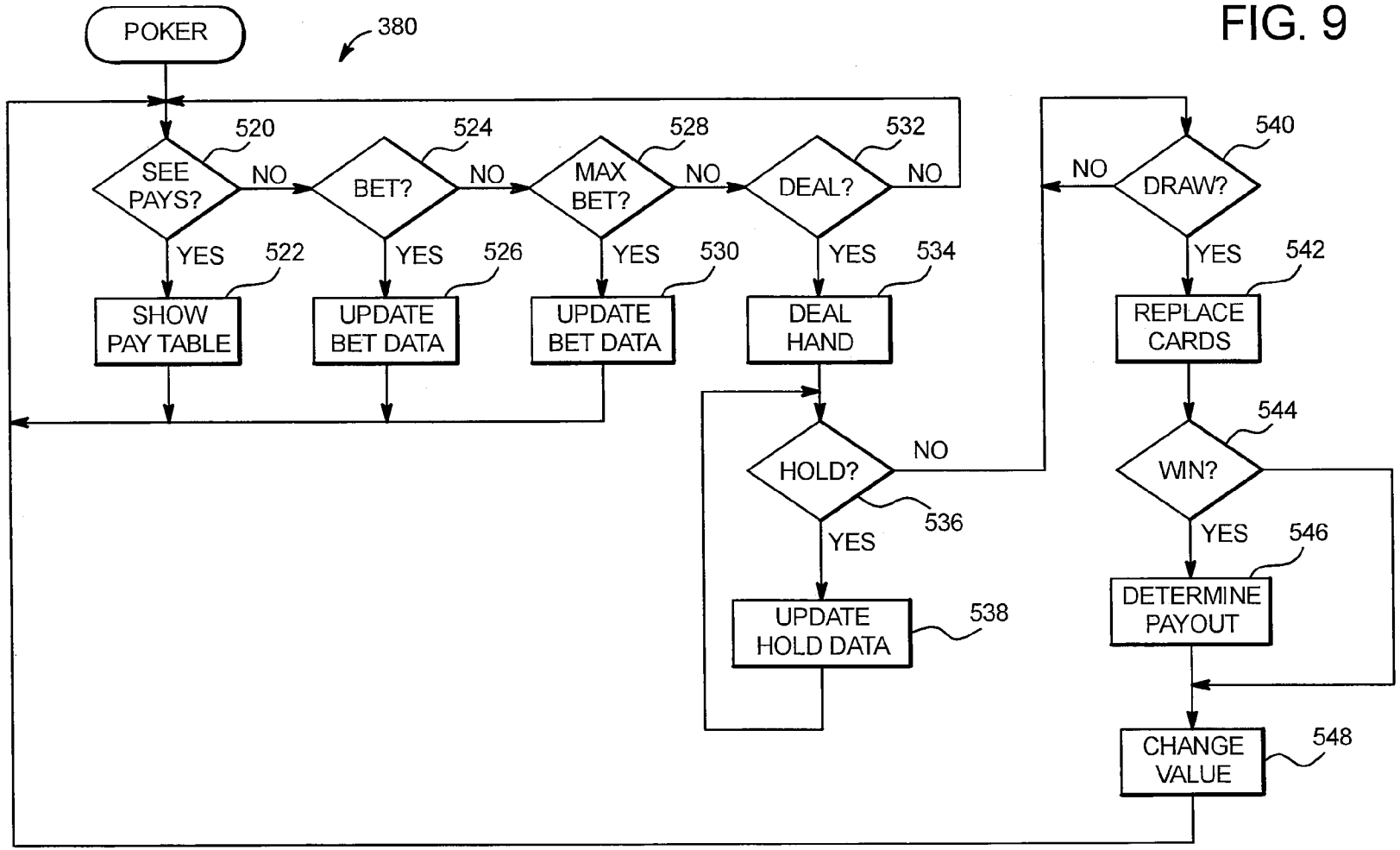
FIG. 9 is a flowchart of an embodiment of a video poker routine that may be performed by one or more of the gaming units.

FIG. 9 is a flowchart of the video poker routine 360 shown schematically in FIG. 4. Referring to FIG. 9, at block 520, the routine may determine whether the player has requested payout information, such as by activating the "See Pays" button 508, in which case at block 522 the routine may cause one or more pay tables to be displayed on the display unit 274. At block 524, the routine may determine whether the player has made a bet, such as by pressing the "Bet One Credit" button 510, in which case at block 526 bet data corresponding to the bet made by the player may be stored in the memory of the controller 310. At block 528, the routine may determine whether the player has pressed the "Bet Max Credits" button 512, in which case at block 530 bet data corresponding to the maximum allowable bet may be stored in the memory of the controller 310.

At block 532, the routine may determine if the player desires a new hand to be dealt, which may be determined by detecting if the "Deal/Draw" button 514 was activated after a wager was made. In that case, at block 534 a video poker hand may be "dealt" by causing the display unit 274 to generate the playing card images 502. After the hand is dealt, at block 536 the routine may determine if any of the "Hold" buttons 504 have been activated by the player, in which case data regarding which of the playing card images 502 are to be "held" may be stored in the controller 310 at block 538. If the "Deal/Draw" button 514 is activated again as determined at block 540, each of the playing card images 502 that was not "held" may be caused to disappear from the video display 500 and to be replaced by a new, randomly selected, playing card image 502 at block 542.

At block 544, the routine may determine whether the poker hand represented by the playing card images 502 currently displayed is a winner. That determination may be made by comparing data representing the currently displayed poker hand with data representing all possible winning hands, which may be stored in the memory of the controller 310. If there is a winning hand, a payout value corresponding to the winning hand may be determined at block 546. At block 548, the player's cumulative value or number of credits may be updated by subtracting the bet made by the player and adding, if the hand was a winner, the payout value determined at block 546. The cumulative value or number of credits may also be displayed in the display area 516 (FIG. 7).

Although the video poker routine 380 is described above in connection with a single poker hand of five cards, the routine 380 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Figure 8:
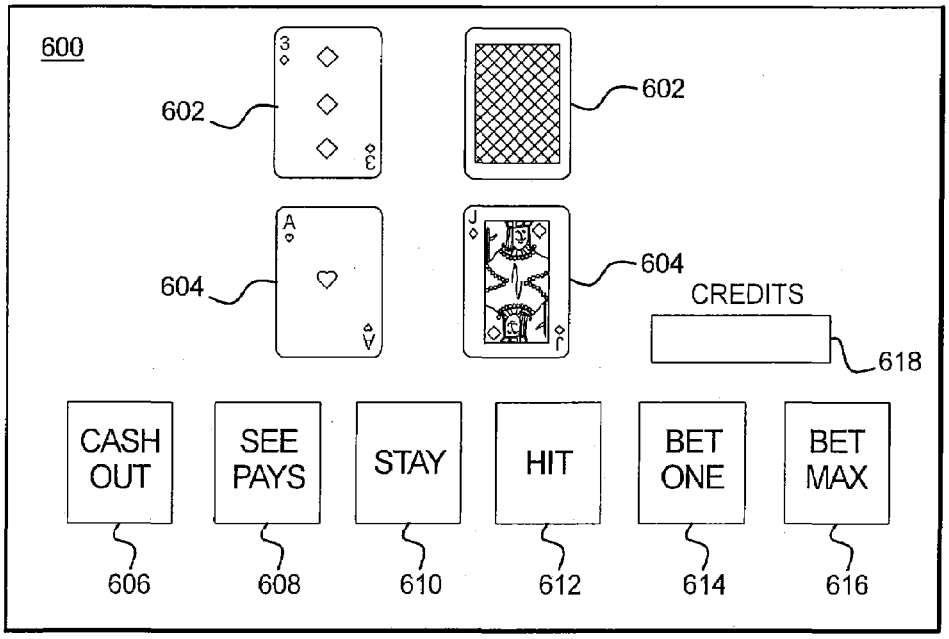
FIG. 8 is an illustration of an embodiment of a visual display that may be displayed during performance of the video blackjack routine of FIG. 10.

Video Blackjack

Where the gaming unit 54 is designed to facilitate play of a video blackjack game, the display unit 274 may comprise a video display unit. FIG. 8 is an exemplary display 600 that may be shown on the display unit 274 during performance of the video blackjack routine 382 shown schematically in FIG. 4. Referring to FIG. 8, the display 600 may include video images 602 of a pair of playing cards representing a dealer's hand, with one of the cards shown face up and the other card being shown face down, and video images 604 of a pair of playing cards representing a player's hand, with both the cards shown face up. The "dealer" may be the gaming unit 54.

To allow the player to control the play of the video blackjack game, a plurality of player-selectable buttons may be displayed. The buttons may include a "Cash Out" button 606, a "See Pays" button 608, a "Stay" button 610, a "Hit" button 612, a "Bet One Credit" button 614, and a "Bet Max Credits" button 616. The display 600 may also include an area 618 in which the number of remaining credits or value is displayed. If the display unit 274 is provided with a touch-sensitive screen, the buttons 606, 608, 610, 612, 614, 616 may form part of the video display 600. Alternatively, one or more of those buttons may be provided as part of a control panel that is provided separately from the display unit 274.

Figure 10:
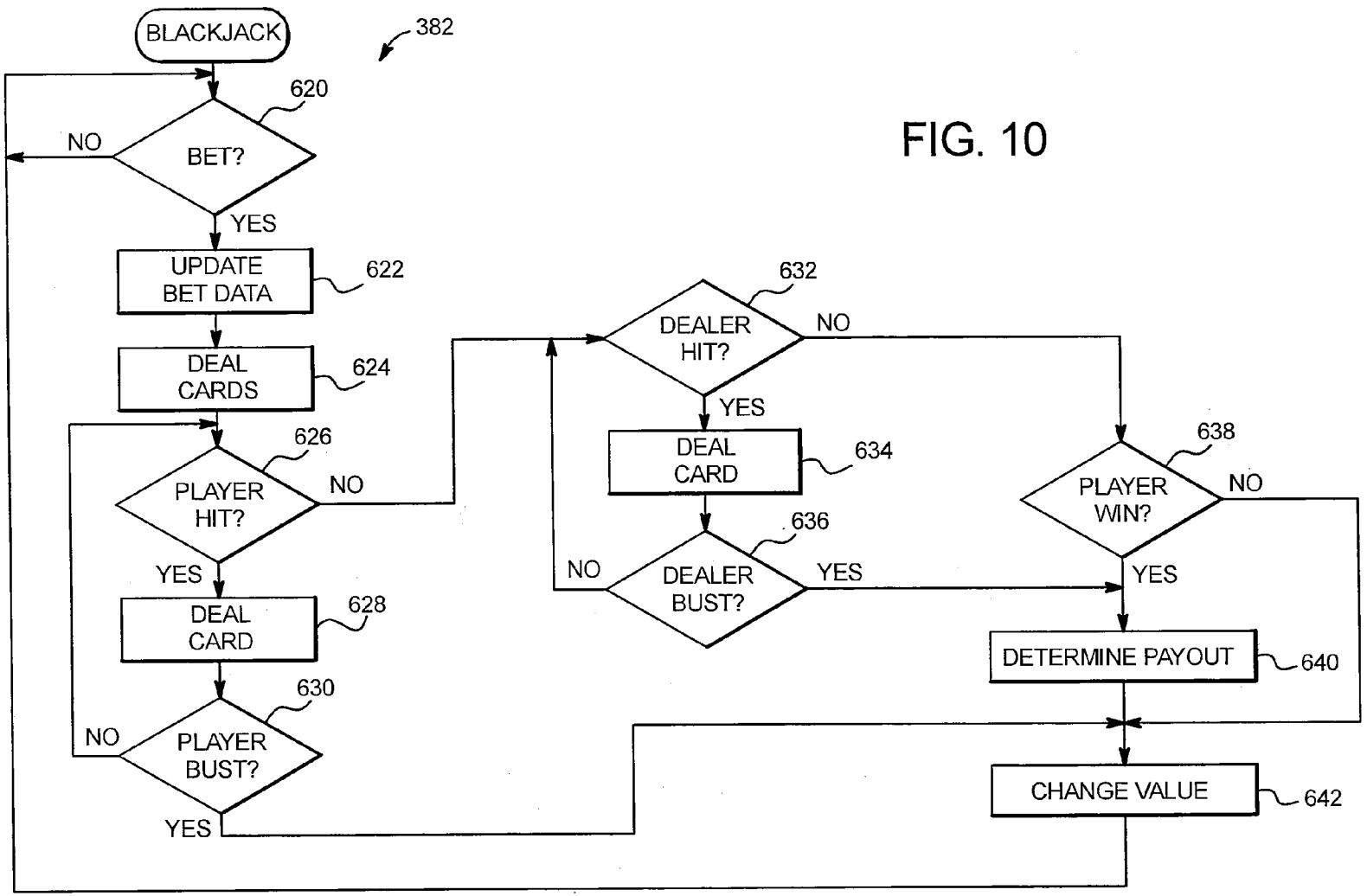
FIG. 10 is a flowchart of an embodiment of a video blackjack routine that may be performed by one or more of the gaming units.

FIG. 10 is a flowchart of the video blackjack routine 382 shown schematically in FIG. 4. Referring to FIG. 10, the video blackjack routine 382 may begin at block 620 where it may determine whether a bet has been made by the player. That may be determined, for example, by detecting the activation of either the "Bet One Credit" button 614 or the "Bet Max Credits" button 616. At block 622, bet data corresponding to the bet made at block 620 may be stored in the memory of the controller 310. At block 624, a dealer's hand and a player's hand may be "dealt" by making the playing card images 602, 604 appear on the display unit 274.

At block 626, the player may be allowed to be "hit," in which case at block 628 another card will be dealt to the player's hand by making another playing card image 604 appear in the display 600. If the player is hit, block 630 may determine if the player has "bust," or exceeded 21. If the player has not bust, blocks 626 and 628 may be performed again to allow the player to be hit again.

If the player decides not to hit, at block 632 the routine may determine whether the dealer should be hit. Whether the dealer hits may be determined in accordance with predetermined rules, such as the dealer always hit if the dealer's hand totals 15 or less. If the dealer hits, at block 634 the dealer's hand may be dealt another card by making another playing card image 602 appear in the display 600. At block 636 the routine may determine whether the dealer has bust. If the dealer has not bust, blocks 632, 634 may be performed again to allow the dealer to be hit again.

If the dealer does not hit, the outcome of the blackjack game and a corresponding payout may be determined based on, for example, whether the player or the dealer has the higher hand that does not exceed 21, as determined at block 638. If the player has a winning hand, a payout value corresponding to the winning hand may be determined at block 640. At block 642, the player's cumulative value or number of credits may be updated by subtracting the bet made by the player and adding, if the player won, the payout value determined at block 640. The cumulative value or number of credits may also be displayed in the display area 618 (FIG. 8).

Figure 11:
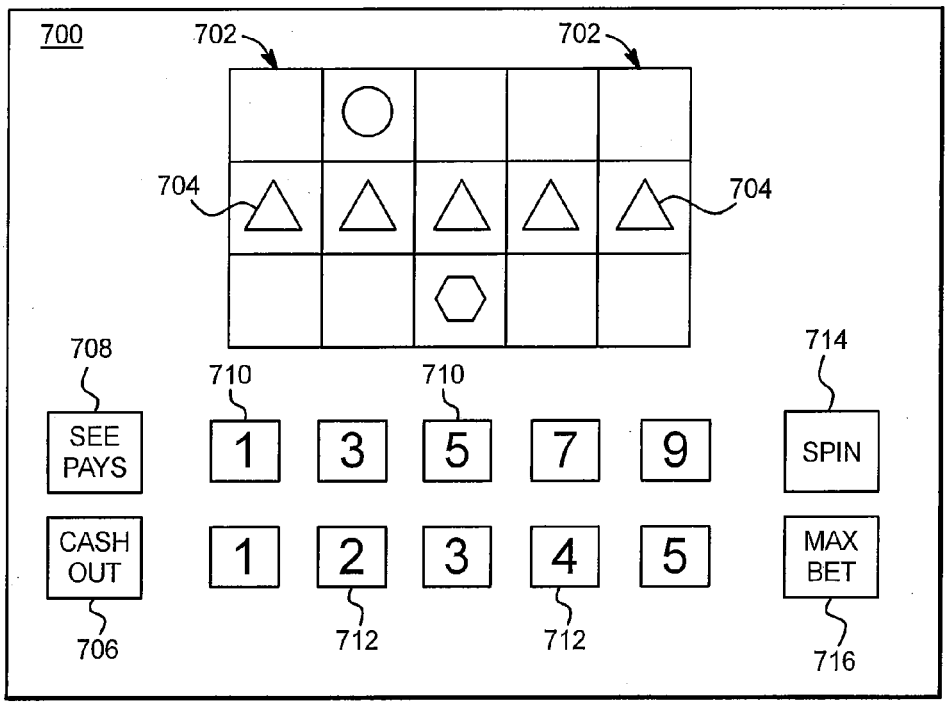
FIG. 11 is an illustration of an embodiment of a visual display that may be displayed during performance of the slots routine of FIG. 13.

Slots

Where the gaming unit 54 is designed to facilitate play of a video slots game, the display unit 274 may comprise a video display unit. FIG. 11 is an exemplary display 700 that may be shown on the display unit 274 during performance of the slots routine 384 shown schematically in FIG. 4. Referring to FIG. 11, the display 700 may include video images 702 of a plurality of slot machine reels, each of the reels having a plurality of reel symbols 704 associated therewith. Although the display 700 shows five reel images 702, each of which may have three reel symbols 704 that are visible at a time, other reel configurations could be utilized.

To allow the player to control the play of the slots game, a plurality of player-selectable buttons may be displayed. The buttons may include a "Cash Out" button 706, a "See Pays" button 708, a plurality of payline-selection buttons 710 each of which allows the player to select a different number of paylines prior to "spinning" the reels, a plurality of bet-selection buttons 712 each of which allows a player to specify a wager amount for each payline selected, a "Spin" button 714, and a "Max Bet" button 716 to allow a player to make the maximum wager allowable.

Figure 13:
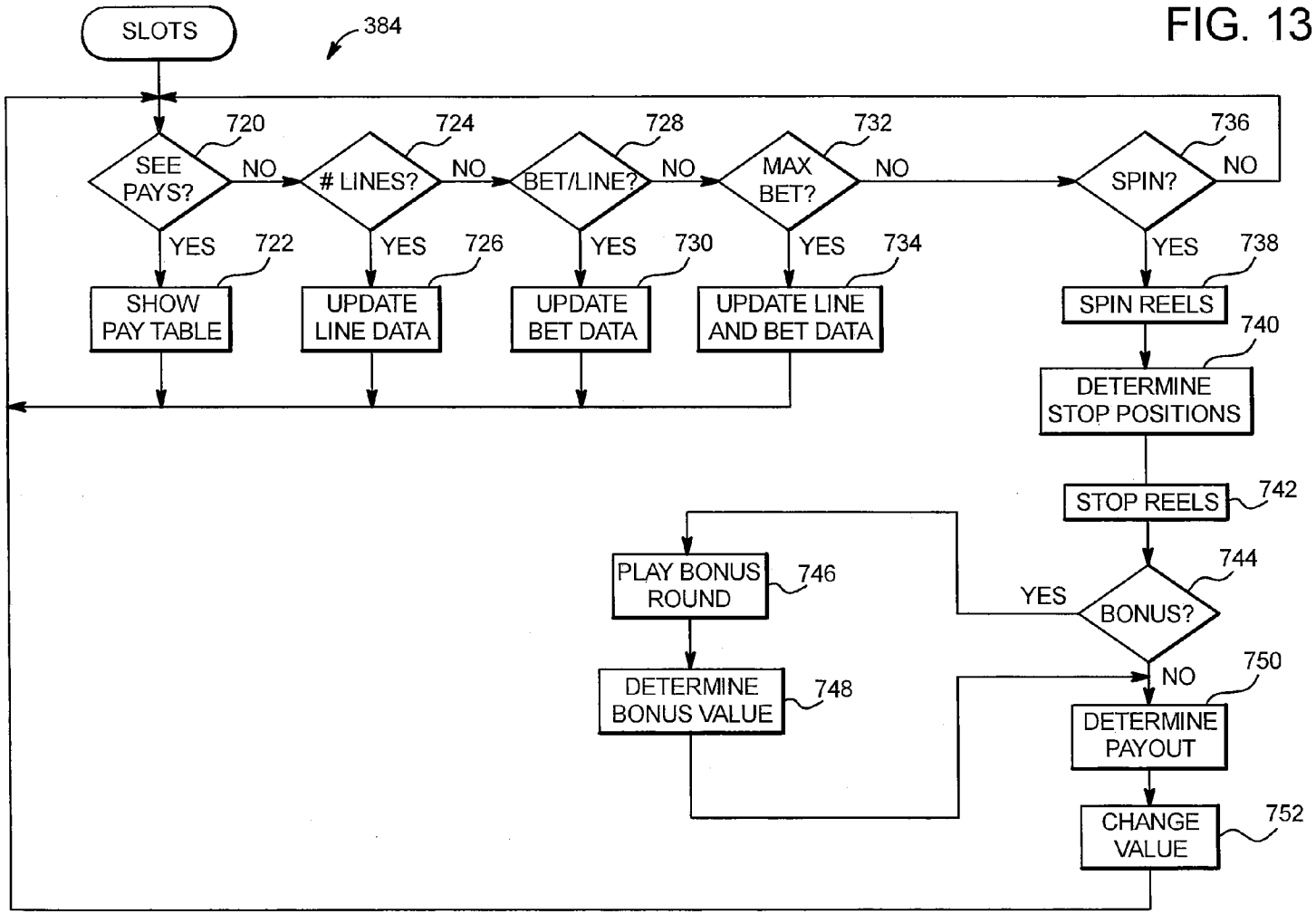
FIG. 13 is a flowchart of an embodiment of a slots routine that may be performed by one or more of the gaming units.

FIG. 13 is a flowchart of the slots routine 384 shown schematically in FIG. 4. Referring to FIG. 13, at block 720, the routine may determine whether the player has requested payout information, such as by activating the "See Pays" button 708, in which case at block 722 the routine may cause one or more pay tables to be displayed on the display unit 274. At block 724, the routine may determine whether the player has pressed one of the payline-selection buttons 710, in which case at block 726 data corresponding to the number of paylines selected by the player may be stored in the memory of the controller 310. At block 728, the routine may determine whether the player has pressed one of the bet-selection buttons 712, in which case at block 730 data corresponding to the amount bet per payline may be stored in the memory of the controller 310. At block 732, the routine may determine whether the player has pressed the "Max Bet" button 716, in which case at block 734 bet data (which may include both payline data and bet-per-payline data) corresponding to the maximum allowable bet may be stored in the memory of the controller 310.

If the "Spin" button 714 has been activated by the player as determined at block 736, at block 738 the routine may cause the slot machine reel images 702 to begin "spinning" so as to simulate the appearance of a plurality of spinning mechanical slot machine reels. At block 740, the routine may determine the positions at which the slot machine reel images will stop, or the particular symbol images 704 that will be displayed when the reel images 702 stop spinning. At block 742, the routine may stop the reel images 702 from spinning by displaying stationary reel images 702 and images of three symbols 704 for each stopped reel image 702. The virtual reels may be stopped from left to right, from the perspective of the player, or in any other manner or sequence.

The routine may provide for the possibility of a bonus game or round if certain conditions are met, such as the display in the stopped reel images 702 of a particular symbol 704. If there is such a bonus condition as determined at block 744, the routine may proceed to block 746 where a bonus round may be played. The bonus round may be a different game than slots, and many other types of bonus games could be provided. If the player wins the bonus round, or receives additional credits or points in the bonus round, a bonus value may be determined at block 748. A payout value corresponding to outcome of the slots game and/or the bonus round may be determined at block 750. At block 752, the player's cumulative value or number of credits may be updated by subtracting the bet made by the player and adding, if the slot game and/or bonus round was a winner, the payout value determined at block 750.

Although the above routine has been described as a video slot machine routine in which slot machine reels are represented as images on the display unit 274, actual slot machine reels that are capable of being spun may be utilized instead, in which case the display unit 274 could be provided in the form of a plurality of mechanical reels that are rotatable, each of the reels having a plurality of reel images disposed thereon.

Moreover, it will be recognized that the determination of whether the player should receive a payout corresponding to the outcome of the slots game, an opportunity to play the bonus game, and/or receive a payout corresponding to the outcome of the bonus game may be made before the reels start "spinning." That is, the outcome of the slots game may be determined shortly after the wager is made and the "Spin" button 714 is depressed, with the animation of the reels (whether mechanical, electro-mechanical, or electrical) being selected according to the outcome to signal the player that a particular outcome has been determined. Likewise, the determination of whether the outcome will provide the opportunity of a bonus game may be made before the animation of the reels, and the outcome of the bonus game before the bonus game is displayed. As a consequence, the order of the determination of the outcome of the slots game or bonus game and the animation of the reels need not be in the order shown in FIG. 13, and, in fact, may be in a different order without departing from the spirit and teaching of this disclosure. Similar remarks may be made in regard to the determinations of the outcomes and animations of the poker and blackjack routines discussed above, and the outcomes and animations of the keno and bingo routines discussed below.

Figure 12:
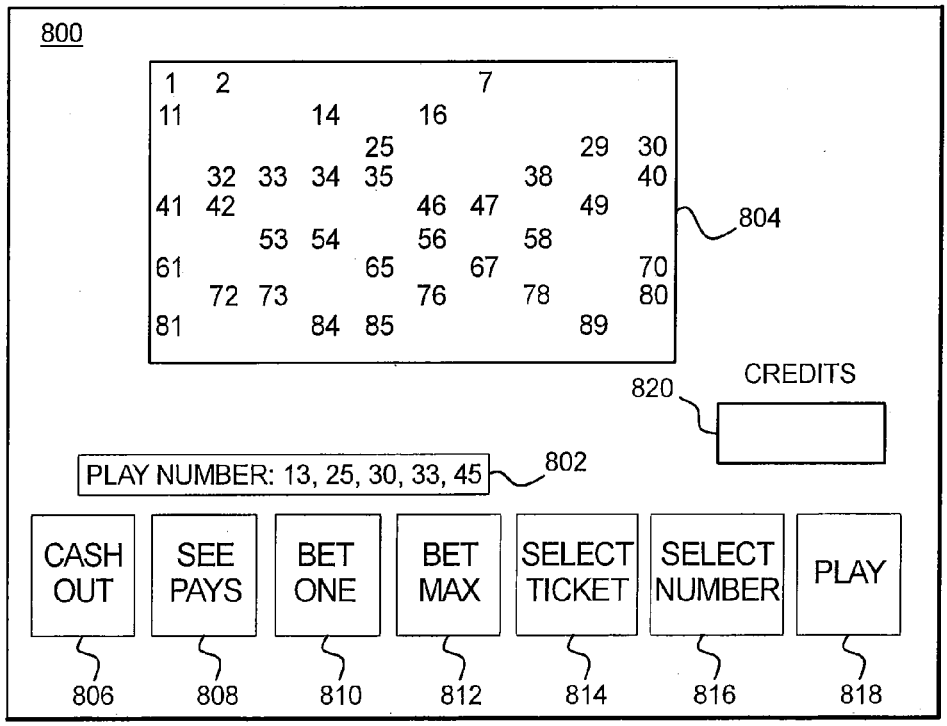
FIG. 12 is an illustration of an embodiment of a visual display that may be displayed during performance of the video keno routine of FIG. 14.

Video Keno

Where the gaming unit 54 is designed to facilitate play of a video keno game, the display unit 274 may comprise a video display unit. FIG. 12 is an exemplary display 800 that may be shown on the display unit 274 during performance of the video keno routine 386 shown schematically in FIG. 4. Referring to FIG. 12, the display 800 may include a video image 802 of a plurality of numbers that were selected by the player prior to the start of a keno game and a video image 804 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 806, a "See Pays" button 808, a "Bet One Credit" button 810, a "Bet Max Credits" button 812, a "Select Ticket" button 814, a "Select Number" button 816, and a "Play" button 818. The display 800 may also include an area 820 in which the number of remaining credits or value is displayed. If the display unit 274 is provided with a touch-sensitive screen, the buttons may form part of the video display 800. Alternatively, one or more of those buttons may be provided as part of a control panel that is provided separately from the display unit 274.

Figure 14:
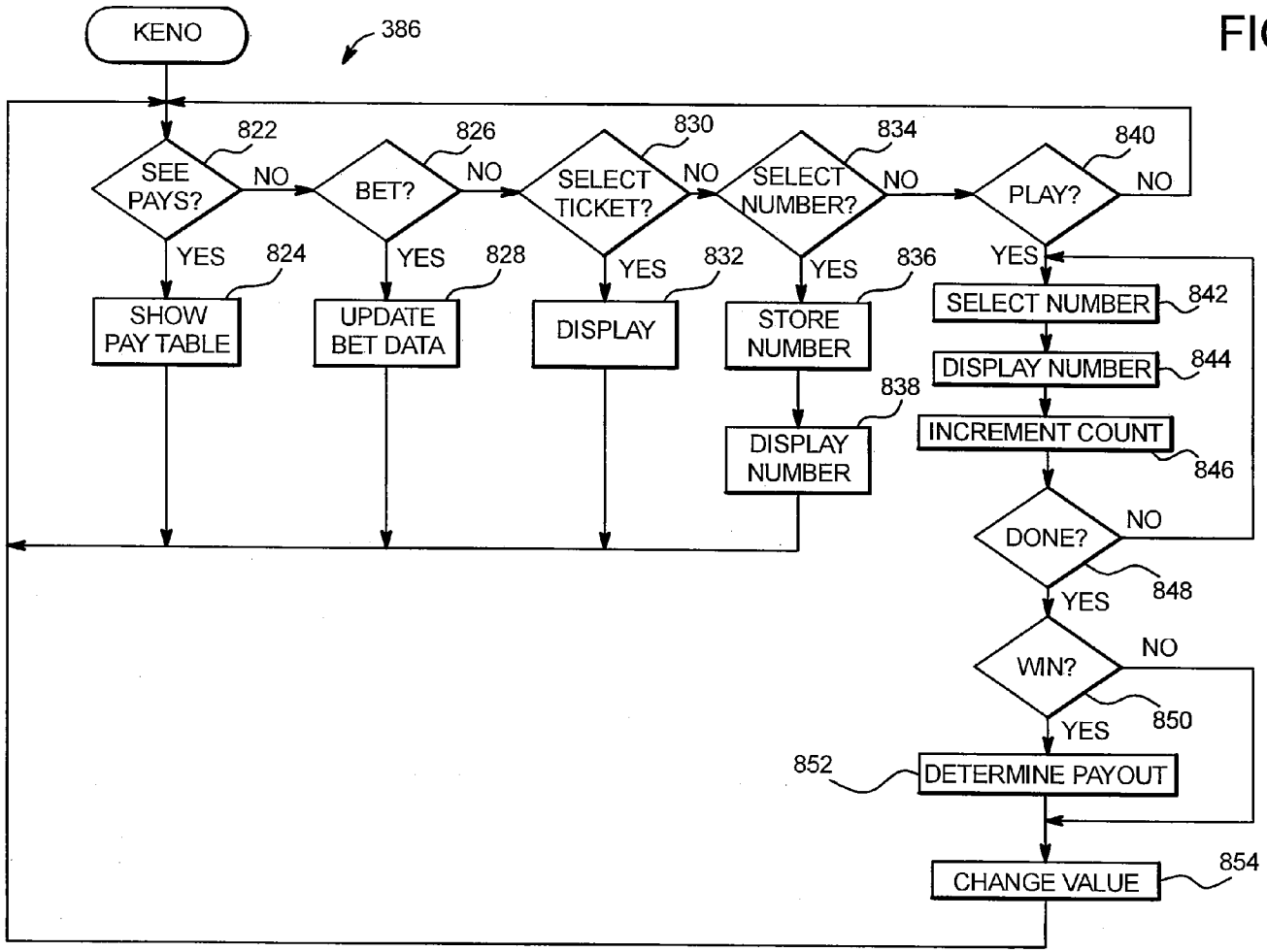
FIG. 14 is a flowchart of an embodiment of a video keno routine that may be performed by one or more of the gaming units.

FIG. 14 is a flowchart of the video keno routine 386 shown schematically in FIG. 4. The keno routine 386 may be utilized in connection with a single gaming unit 54 where a single player is playing a keno game, or the keno routine 386 may be utilized in connection with multiple gaming units 54 where multiple players are playing a single keno game. In the latter case, one or more of the acts described below may be performed either by the controller 310 in each gaming unit or by one of the network computers 56, 76, 110, 112 to which multiple gaming units 54 are operatively connected.

Referring to FIG. 14, at block 822, the routine may determine whether the player has requested payout information, such as by activating the "See Pays" button 808, in which case at block 824 the routine may cause one or more pay tables to be displayed on the display unit 274. At block 826, the routine may determine whether the player has made a bet, such as by having pressed the "Bet One Credit" button 810 or the "Bet Max Credits" button 812, in which case at block 828 bet data corresponding to the bet made by the player may be stored in the memory of the controller 310. After the player has made a wager, at block 830 the player may select a keno ticket, and at block 832 the ticket may be displayed on the display 800. At block 834, the player may select one or more game numbers, which may be within a range set by the casino. After being selected, the player's game numbers may be stored in the memory of the controller 310 at block 836 and may be included in the image 802 on the display 800 at block 838. After a certain amount of time, the keno game may be closed to additional players (where a number of players are playing a single keno game using multiple gambling units 54).

If play of the keno game is to begin as determined at block 840, at block 842 a game number within a range set by the casino may be randomly selected either by the controller 310 or a central computer operatively connected to the controller, such as one of the network computers 56, 76, 110, 112. At block 844, the randomly selected game number may be displayed on the display unit 274 and the display units 274 of other gaming units 54 (if any) which are involved in the same keno game. At block 846, the controller 310 (or the central computer noted above) may increment a count which keeps track of how many game numbers have been selected at block 842.

At block 848, the controller 310 (or one of the network computers 56, 76, 110, 112) may determine whether a maximum number of game numbers within the range have been randomly selected. If not, another game number may be randomly selected at block 842. If the maximum number of game numbers has been selected, at block 850 the controller 310 (or a central computer 56, 76, 110, 112) may determine whether there are a sufficient number of matches between the game numbers selected by the player and the game numbers selected at block 842 to cause the player to win. The number of matches may depend on how many numbers the player selected and the particular keno rules being used.

If there are a sufficient number of matches, a payout may be determined at block 852 to compensate the player for winning the game. The payout may depend on the number of matches between the game numbers selected by the player and the game numbers randomly selected at block 842. At block 854, the player's cumulative value or number of credits may be updated by subtracting the bet made by the player and adding, if the keno game was won, the payout value determined at block 852. The cumulative value or number of credits may also be displayed in the display area 820 (FIG. 12).

Figure 15:
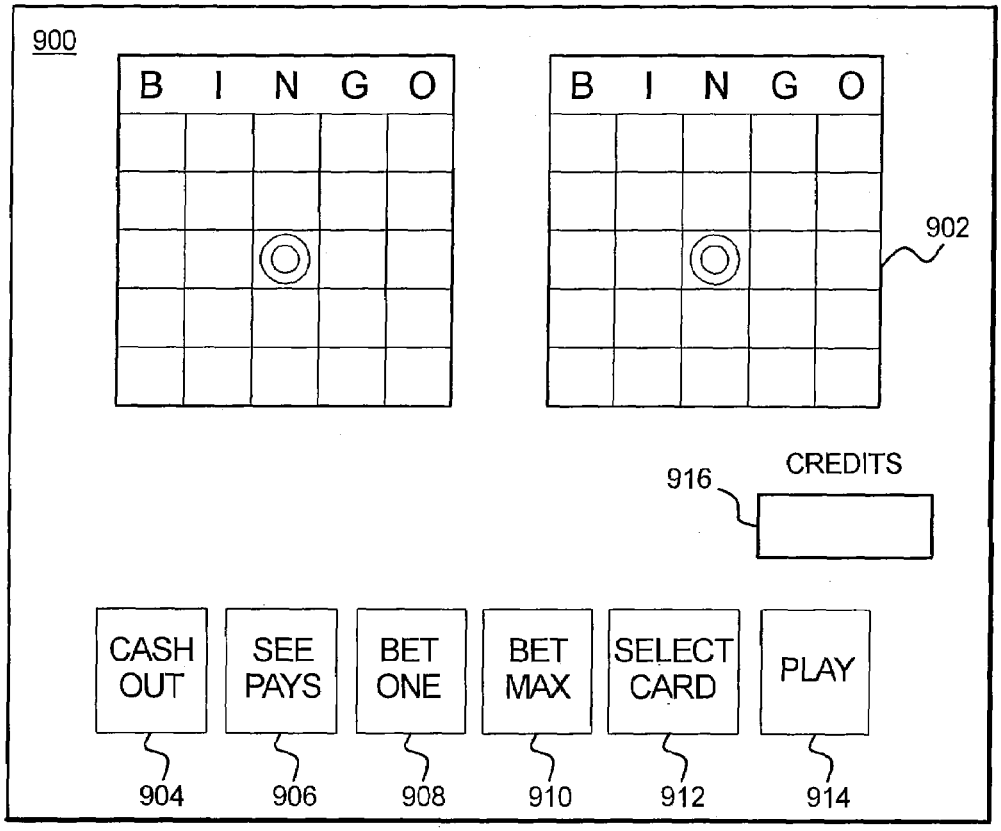
FIG. 15 is an illustration of an embodiment of a visual display that may be displayed during performance of the video bingo routine of FIG. 16.

Video Bingo

Where the gaming unit 54 is designed to facilitate play of a video bingo game, the display unit 274 may comprise a video display unit. FIG. 15 is an exemplary display 900 that may be shown on the display unit 274 during performance of the video bingo routine 388 shown schematically in FIG. 4. Referring to FIG. 15, the display 900 may include one or more video images 902 of a bingo card and images of the bingo numbers selected during the game. The bingo card images 902 may have a grid pattern.

To allow the player to control the play of the bingo game, a plurality of player-selectable buttons may be displayed. The buttons may include a "Cash Out" button 904, a "See Pays" button 906, a "Bet One Credit" button 908, a "Bet Max Credits" button 910, a "Select Card" button 912, and a "Play" button 914. The display 900 may also include an area 916 in which the number of remaining credits or value is displayed. If the display unit 274 is provided with a touch-sensitive screen, the buttons may form part of the video display 900. Alternatively, one or more of those buttons may be provided as part of a control panel that is provided separately from the display unit 274.

Figure 16:
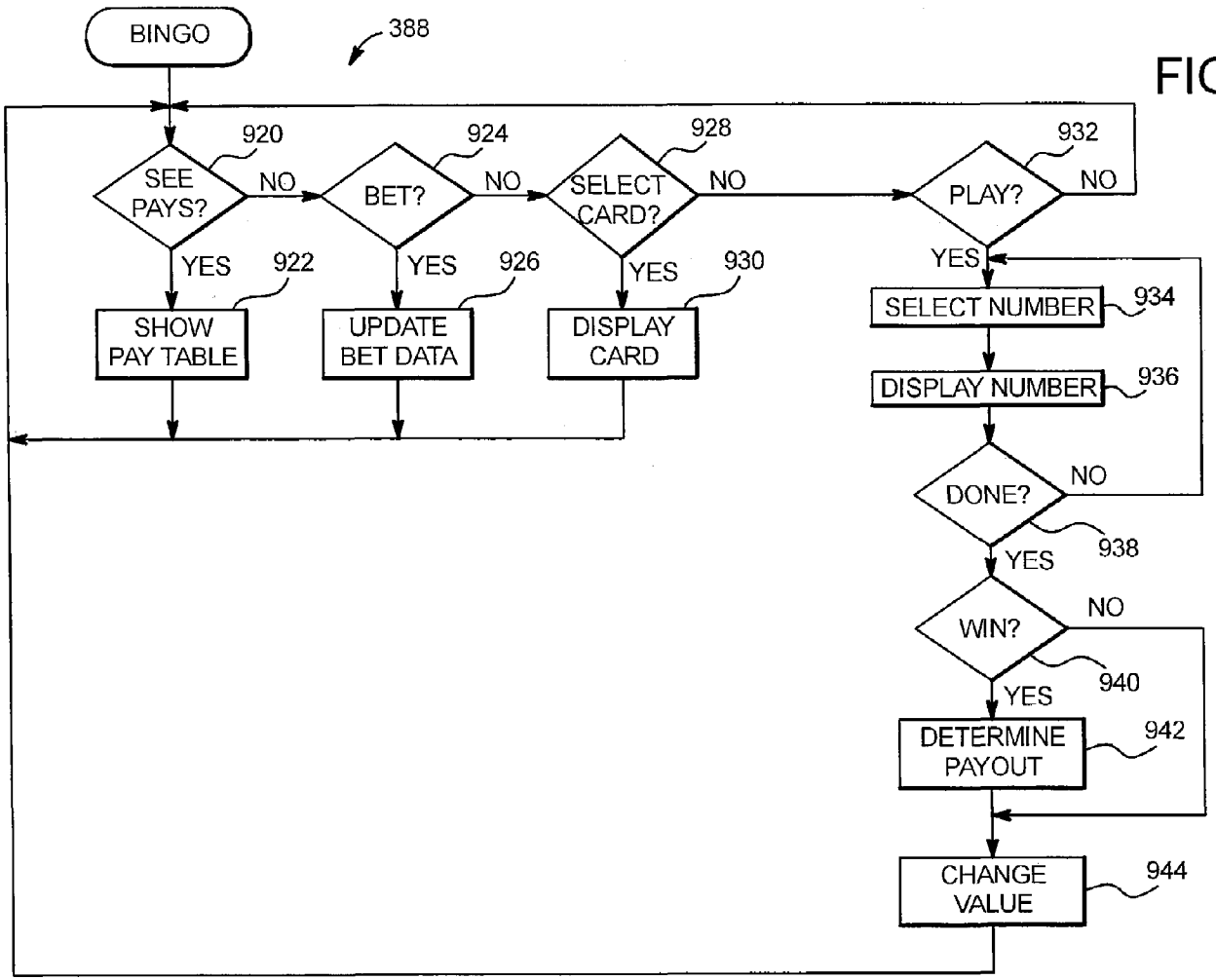
FIG. 16 is a flowchart of an embodiment of a video bingo routine that may be performed by one or more of the gaming units.

FIG. 16 is a flowchart of the video bingo routine 388 shown schematically in FIG. 4. The bingo routine 388 may be utilized in connection with a single gaming unit 54 where a single player is playing a bingo game, or the bingo routine 388 may be utilized in connection with multiple gaming units 54 where multiple players are playing a single bingo game. In the latter case, one or more of the acts described below may be performed either by the controller 310 in each gaming unit 54 or by one of the network computers 56, 76, 110, 112 to which multiple gaming units 54 are operatively connected.

Referring to FIG. 16, at block 920, the routine may determine whether the player has requested payout information, such as by activating the "See Pays" button 906, in which case at block 922 the routine may cause one or more pay tables to be displayed on the display unit 274. At block 924, the routine may determine whether the player has made a bet, such as by having pressed the "Bet One Credit" button 908 or the "Bet Max Credits" button 910, in which case at block 926 bet data corresponding to the bet made by the player may be stored in the memory of the controller 310.

After the player has made a wager, at block 928 the player may select a bingo card, which may be generated randomly. The player may select more than one bingo card, and there may be a maximum number of bingo cards that a player may select. The card or cards may be added to the display 900 at block 930. After play is to commence as determined at block 932, at block 934 a bingo number may be randomly generated by the controller 310 or a central computer such as one of the network computers 56, 76, 110, 112. At block 936, the bingo number may be displayed on the display unit 274 and the display units 274 of any other gaming units 54 involved in the bingo game.

At block 938, the controller 310 (or a central computer) may determine whether any player has won the bingo game. If no player has won, another bingo number may be randomly selected at block 934. If any player has bingo as determined at block 938, the routine may determine at block 940 whether the player playing that gaming unit 54 was the winner. If so, at block 942 a payout for the player may be determined. The payout may depend on the number of random numbers that were drawn before there was a winner, the total number of winners (if there was more than one player), and the amount of money that was wagered on the game. At block 944, the player's cumulative value or number of credits may be updated by subtracting the bet made by the player and adding, if the bingo game was won, the payout value determined at block 942. The cumulative value or number of credits may also be displayed in the display area 916 (FIG. 15).

Payout Exchange Routine

Figure 17:
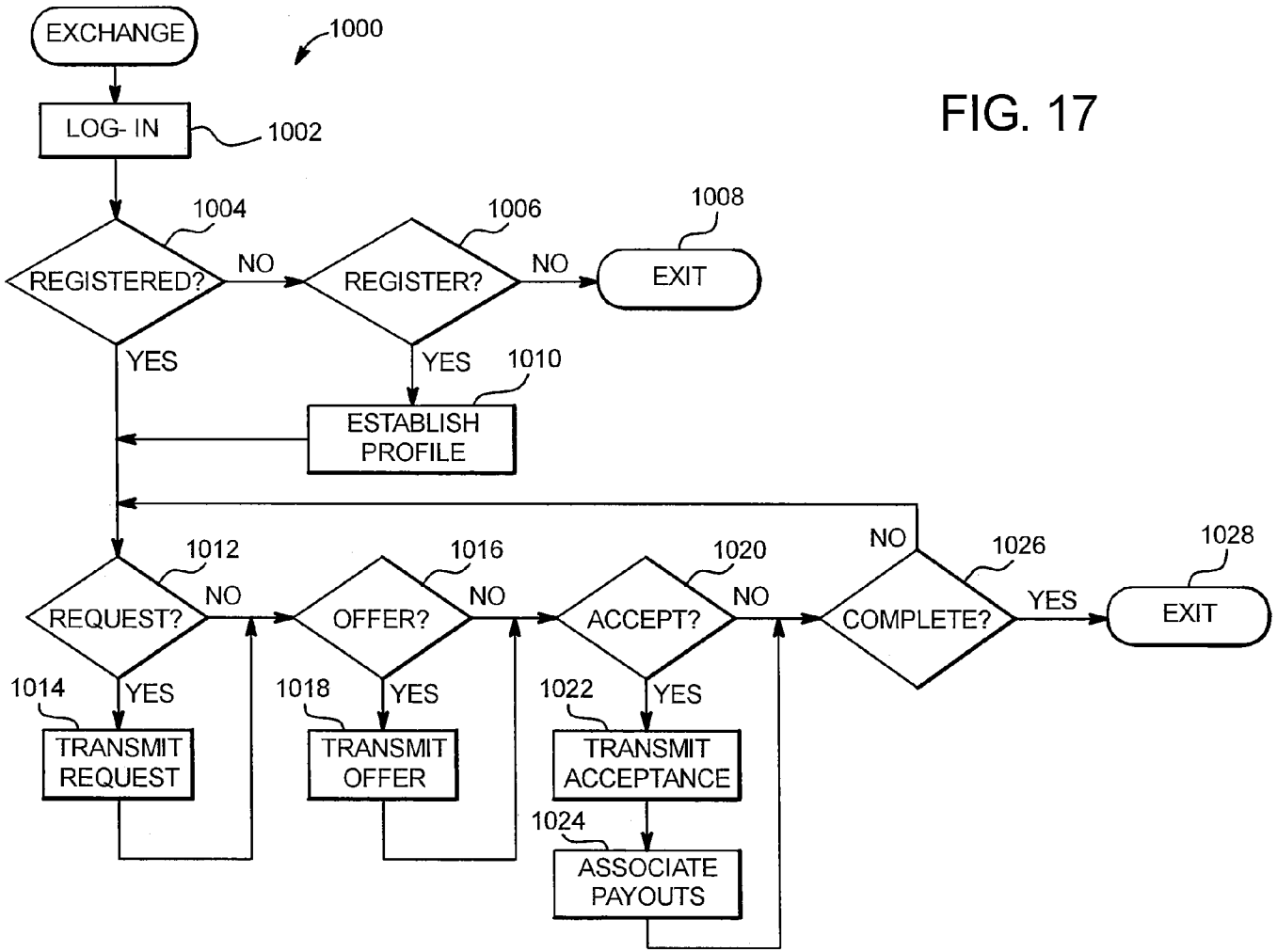
FIG. 17 is a flowchart of an embodiment of a payout exchange routine that may be performed during operation of the payout exchange aspect of the system of FIG. 1.

FIG. 17 is a flowchart of a payout exchange routine 1000 that may be stored in the memory of one of the network computers 110, 112, for example, which network computer 110, 112 would then operate at least as a payout exchange server, or one of more of the gaming units 94 in a network like that of the network 92 where the gaming units 94 share the operations of a server. Referring to FIG. 17, the routine 1000 begins after the player has been awarded one or more payouts in during the play of one of the gaming units 54, 74, 75, 94, 130, as explained above relative to FIGS. 4–16. Alternatively, the payouts may have been awarded based on some other criteria, for example as part of a bonusing system, player tracking system, etc. According to this embodiment, at least one of the one or more payouts may include the right to redeem the payout for a good or a service. For example, the player may receive a payout in the form of a payout instrument (which may be in the form or a coupon or voucher, whether physical or electronic) for a leather jacket according to a determination made based on an outcome of one of the games discussed above (for example, a slots game).

The routine begins when the player logs in to the payout exchange aspect of the system 50 at the block 1002. The player may log in to the payout exchange aspect of the system 50 using one of the gaming units 54, 74, 75, 94, 130, personal communication units 64, 84, 126 or the kiosk 88, for example. According to an embodiment, the controller 310 of the gaming unit 54, for example, may be programmed to present one or more images on the display 274 that illustrate different operations of the payout exchange aspect of the system 50. According to this embodiment, the controller 310 may also be programmed, where a touchscreen is used in conjunction with the display unit 274, for example, to configure at least a portion of the image displayed on the display unit 274 in the form of one or more buttons, which buttons may be used to permit the player to provide inputs to the gaming unit 54. It will be recognized that a keyboard, for example, may be used in substitution for or in conjunction with the touchscreen/display unit 274 described previously. For that matter, it will be recognized that a similar arrangement of touchscreen/display unit 274 may be used in conjunction with an apparatus that does not provide the gaming routine(s) discussed above (e.g., the kiosk 88), which apparatuses may be dispersed over the casino floor as a convenience for the player and for persons who, having played and received payouts earlier, wish to use the payout exchange aspect of the system 50 before redeeming their payouts.

After the log in information or data is received by the gaming unit 54, for example, the log in information or data is transferred to and received by the at least one of the network computers 110, 112, which according to this embodiment operates as a payout exchange server. For ease of illustration, the network computer 110 will be designated the payout exchange server, although this should not be taken as limiting the payout exchange server to network computer 110 only. The payout exchange server 110 determines if the player is registered to use the payout exchange aspect of the system 50 at block 1004. If the server 110 determines that the player is not registered, the routine proceeds to block 1006, wherein the server 110 inquires, via the gaming unit 54, whether the player wishes to register with the payout exchange aspect of the system 50. If the player does not wish to register, the routine 1000 exits at block 1008; if the player does wish to register, the routine 1000 passes to block 1010.

At block 1010, the server 110 may associate an identifier with the player, and establish a payout exchange profile for the player. The payout exchange profile may be nothing more than a memory storage location associated with the identifier, which memory storage location may be used by the player to store electronic information or data concerning one or more payouts that the player wishes to exchange using the payout exchange aspect of the system 50. In this sense, this form of player exchange profile may be regarded to be anonymous, in the sense that there is no information associated with the profile other than the identifier. However, the payout exchange profile may also include one or more data records, which data records may include personal information concerning the player that may facilitate the transactions undertaken using the payout exchange aspect of the system 50. For example, certain jurisdictions may consider the exchange of payouts between players via the payout exchange aspect of the system 50 to be a taxable event; in such a case, the player's payout exchange profile may include information useful in preparing forms for reporting the taxable event to the appropriate authorities. Furthermore, the player may wish to associate other data records with their profile, which data records may be used to store information or data concerning the player's choices in presenting his or her payouts for exchange, such as which methods of exchange are preferred or how the payout will be displayed when offers are solicited. At block 1010, the player's payout exchange profile is established on the server 110, for example by storing the identifier and profile in a database associated with the server 110.

If the server 110 determines at block 1004 that the player is registered to use the payout exchange aspect of the system 50 or if the player registers at blocks 1006, 1010, the routine 1000 proceeds to block 1012, wherein a determination is made as to whether the player has a request for exchange that the player wishes to transmit to at least one other player using the payout exchange aspect of the system 50. According to the present embodiment of the payout exchange aspect of the system 50, the request may be one of at least three different types (although other types may be used): auction, reverse auction and barter. According to the auction type, the player requests an exchange of at least one or his or her payouts, which request is broadcast to a plurality of players registered to use the payout exchange aspect of the gaming system 50. This broadcast may be in the form of messages particularly directed to each of the players that are part of the plurality of registered players, or, alternatively, the broadcast may in the form of a message posted on a bulletin board or to a central site to which all of the players of the plurality of registered players may have access. According to the reverse auction type, the player requests a particular payout which he or she would like to obtain, which request is broadcast to the plurality of registered players. According to the barter type, the player may request that all or certain payouts be transmitted to another player (or broadcast to a plurality of players) to solicit offers of a specific exchange of payouts; it may also be stated that this initial request from the first player represents an offer that the other player (or one of the plurality of players) then accepts. If it is determined that the player wishes to submit a request at block 1012, the request is transmitted at block 1014 according to the particular nature of the request (e.g., auction, reverse auction, or barter).

If the server 110 determines at block 1012 that no request has been received from the player or if the player's request has been transmitted at block 1014, the routine proceeds to block 1016. At block 1016, a determination is made if an offer has been received from one of the other players of the plurality of registered players in response to the request transmitted at block 1014. If any offer has been received in regard to the request for an exchange transmitted at block 1014, then the server 110 transmits the offer from the player who made the offer to the player who requested the offer at block 1018.

According to an embodiment of the present disclosure, the offer may be in terms of a payout awarded to the other, or offering, player as a consequence of that player's use of the gaming aspect of the system 50, for example. That is, the offer may be in term of a payout associated with the other player according to an outcome that is determined for a game. Alternatively, the payout may have been associated with the other player in response to an event occurring in a player tracking, bonusing or promotional aspect of the system 50. As a further alternative, the offer may be made in terms of a payout associated with the player as well as some other type of value, such as credits or currency.

As for the nature of the offer, the content of the offer will vary in accordance with the request transmitted. For example, if the request transmitted (broadcast) was an auction-type request, the offer received and transmitted to the first player may be an offer to exchange a second payout for the first payout being auctioned. As another example, if the request transmitted (broadcast) was a reverse auction-type request, the offer received and transmitted to the first player may be an offer to exchange the second payout being sought for a first payout from the requesting player.

If there are no new offers received (i.e., all offers previously received have already been transmitted to the requesting player) or if the offers recently received have been transmitted at block 1018, then the routine 1000 proceeds to block 1020. At block 1020, a determination is made if an acceptance has been received in response to one of the offers received and transmitted at block 1018. The acceptance may be in the form of an input or communication received from the requesting player, and may represent a selection of one of the one or more offers received. The acceptance may also be performed automatically, even though the acceptance may still be referred to as having been received from the requesting player. That is, the payout auction server may be programmed to review the one or more offers received and select one of the offers according to one or more selection criteria established in advance.

The selection criteria used may include numerous considerations, of which only a partial list follows; it will be recognized that other variations would also come within the scope of this disclosure. The selection criteria used by the payout exchange server may be determined, for example, by the requesting player. Alternatively, the network or system operator may determine the selection criteria. The selection criteria may include positive criteria (e.g., "select the offer of the payout that has the greatest value associated therewith") and/or negative criteria (e.g., "do not select an offer of game credits"). The selection criterion may include a single criterion (e.g., "select the offer of the payout that has the greatest value associated therewith") or may include a plurality of criteria (e.g., "do not select an offer of game credits", "do not select an offer related to food or lodging", "do not select an offer of player tracking points", etc.). Where a plurality of criteria are used, the criteria may depend on each other (e.g., "select an offer of food or lodging", "if an offer of food and lodging is received, select the offer of the payout that has the greatest value associated therewith", etc.). Consequently, considerable variation is possible relative to the selection criteria.

If an acceptance has been received from the requesting player, then the routine 1000 proceeds to block 1022. At block 1022, the server 110 transmits the acceptance to the player who made the offer selected. In either the auction-type setting or the reverse auction-type setting, the server 110 would transmit an acceptance from the requesting player to the offering player to exchange the first payout for the second payout.

Moreover, at block 1024, the server 110 may update the player profiles for the requesting player and the offering player to reflect the exchange agreed to by the offer and acceptance. For example, the server 110 may disassociate the first payout with the requesting player and the second payout with the offering player, and then associate the second payout with the requesting player and the first payout with the offering player. Alternatively, the exchange may be performed according to some other mechanism by which the requesting player gives up his or her rights to the first payout and gains the rights to the second payout, and vice versa for the offering player.

If the server determines at block 1020 that no acceptance has been received or after the payouts are exchanged at block 1024, the routine 1000 proceeds to block 1026. The server 101 determines at block 1026 if the player has completed his or her use of the payout exchange aspect of the system 50. For example, if the player has requested an exchange for only one payout, once the requesting player has accepted an offer and the exchange has taken place, the player's use of the payout exchange aspect of the system 50 may be complete. On the other hand, if the player has not yet accepted an exchange or if the player has requested exchanges for several payouts and not accepted exchanges for each of these payouts, the determination may be made that the player has not completed use of the payout exchange aspect of the system 50. If the determination is made that the player has completed his or her use, the routine 1000 proceeds to block 1028; alternatively, if the determination is made that the player has not completed his or her use of the payout exchange aspect, the routine returns to block 1012.

It will be recognized that a single request transmitted (e.g., broadcast) at block 1014 may solicit numerous offers in return. Likewise, the activity at blocks 1012 (request) and 1020 (acceptance) may occur only once per request cycle. Consequently, while the routine 1000 has been shown as a series of determinations 1012, 1016, 1020, 1026, it may be preferable to conduct some of these activities more frequently than other activities. Alternatively, if the desire is to cycle through the blocks 1012, 1016, 1020, 1026 on a fixed frequency, it may be preferable to make accommodation to store the messages received or transmitted until the cycle repeats. Further alternatives may include other variations in the routine 1000, which variations may be represented through the inclusion of returns loops at other points in the flowchart shown in FIG. 17; for example, if an auction-type exchange mechanism is used, the routine 1000 might loop back to block 1016 rather than looping back to block 1012. It will be understood that these variations and others are within the scope of this disclosure.

Moreover, although the request, offer and acceptance discussed above are phrased in terms of one-for-one payout exchange, this need not be the case. For example, in response to a request from a first player to exchange a first payout the server 110 may receive an offer from a second player to exchange a second payout and a third payout for the first payout. Similarly, in response to a request from a first player for a first payout, the server 110 may receive an offer from a second player for exchange the first payout for a second payout and a third payout. Moreover, the first player may offer to exchange a first payout and a second payout for a third payout and a fourth payout from a second player. Consequently, it will be recognized that the payout exchange aspect of the system 50 is not limited to a one-for-one exchange of payouts, but may include a one-for-many or a many-for-many exchange.

As a further alternative, while the preceding passage described the server 110 as operating according to the routine 1000, more than one server may be utilized to perform the routine 1000. For example, one server may be dedicated to the aspects of payout exchange concerning auctions, another server may be dedicated to the aspects of payout exchange concerning reverse auctions, and still another server may be dedicated to the aspects of payout exchange concerning bartering. Further servers may be used to coordinate the activities of the auction, reverse auction, and barter servers, and to operate as databases for the administration and storage of the player payout exchange profiles. Still other servers may be used to coordinate the payout exchange aspects of the system 50 with a redemption system for the payouts being exchanged that have not yet been redeemed by the players (i.e., that still exist merely as an instrument providing the right to redeem the instrument for the item identified therein, rather than as the item itself). It will be further recognized that no server need be used, and that the operation of the payout exchange aspects of the system 50 may be distributed among a plurality of gaming units, such as gaming units 94, which operate as a peer-to-peer network.

The following is an example of the operation of the payout exchange aspect of the system 50 according to an embodiment of the system 50. This example is for illustration purposes only, and is not meant to limit the scope of the claims thereby, or to emphasize one embodiment discussed over another.

According to this example, a first player has been playing slots on one of the gaming units 54, and has received several electronic coupons redeemable for a leather jacket, a purse, and a floral bouquet as a consequence of outcomes determined. A second player has been playing video poker on one of the gaming units 74, and has received electronic coupons redeemable for a motorcycle helmet and five free games. A third player has been playing keno at one of the gaming units 94, and has received electronic coupons for a free steak dinner and tickets to a dance review. The three players, as well as a plurality of other players, have logged into the payout exchange aspect of the system 50 (block 1002) and are registered (as determined at block 1004).

At block 1012, the determination is made that the first player wishes to place two requests. The first request is a reverse auction-type request for a motorcycle helmet. The second request is an auction-type request of the floral bouquet. The server 110 broadcasts both of these requests to the other registered players at block 1014. The routine 1000 then proceeds to block 1016.

Figure 18:
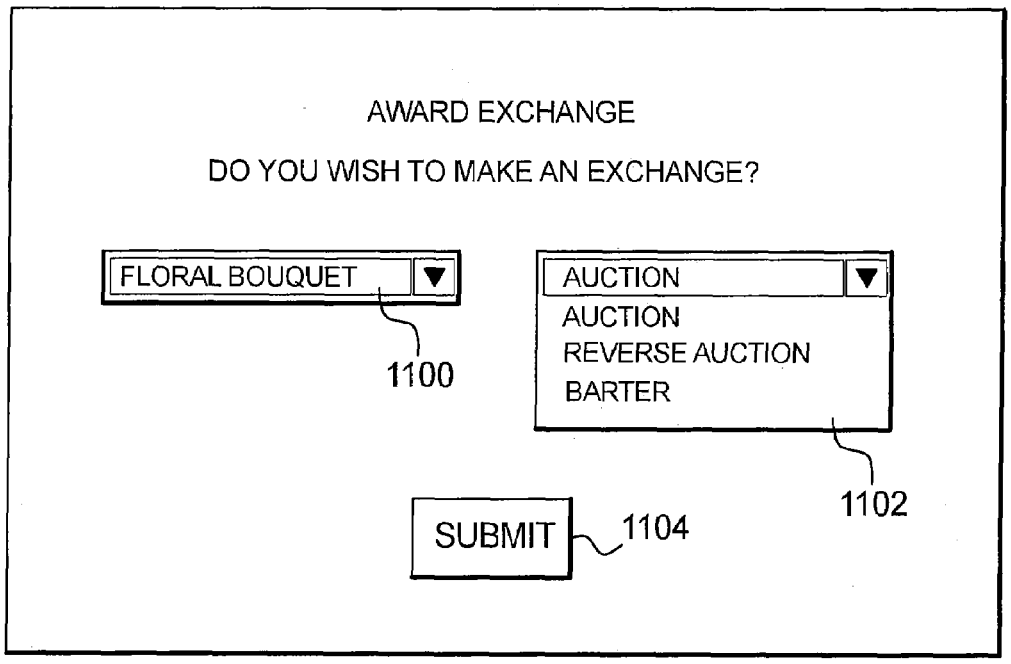
FIG. 18 is an illustration of an embodiment of a first visual display that may be displayed during the performance of the payout exchange routine of FIG. 17.

For example, an image may be displayed on the display unit 274, in accordance with FIG. 18, and a touchscreen in combination with the display unit 274 may be used to receive player input in regard to the image displayed. As is illustrated, the interface between the player and the payout exchange system may include a series of lists 1100, 1102, one (1100) for the items that may be exchanged by the player and another (1102) for the type of exchange that the player would like to use to exchange a particular item. The lists may be closed, i.e., all of the possible options permitted by the payout exchange system are included in the list. Alternatively, the lists may be open, i.e., the player may be permitted to increase the available options by adding to lists, which lists may already include one or more options placed there by the operator of the payout exchange aspect of the system 50. For example, the list 1100 may be open—it may be possible for the player to add and subtract the payouts that he or she wishes to exchange using the payout exchange aspect. Alternatively, the list 1102 may be closed—the payout exchange aspect may only offer the three types of exchange methods listed (auction, reverse auction, and barter). Moreover, in lieu of the list 1100 shown, the player may be inquired as to each of his or her payouts one at a time. Further, the list 1102 may be removed where each type of exchange method is handled by the payout exchange aspect separately. Other variations will also be recognized. A "Submit" button 1104 may be included to be used by the player to input his or her desire to make the particular request selected (e.g., to exchange the floral bouquet using an auction-type exchange method).

Figure 19:
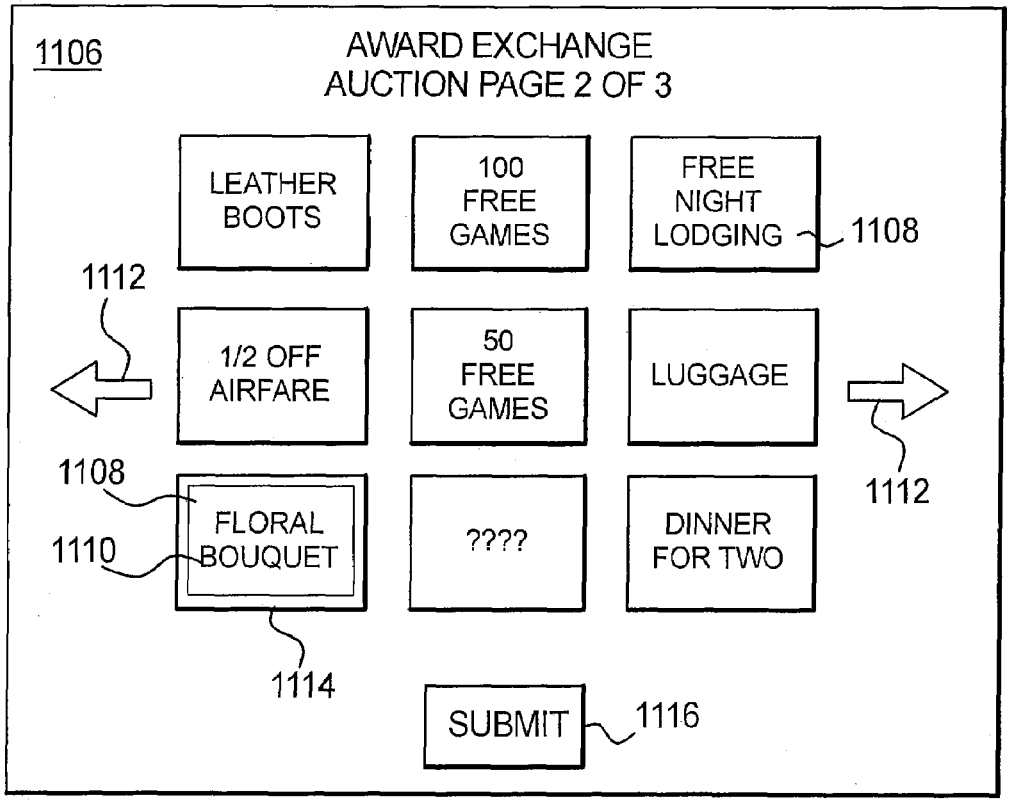
FIG. 19 is an illustration of an embodiment of a second visual display that may be displayed during the performance of the payout exchange routine of FIG. 17.

As to the broadcast of the requests for offers, this may be done in any number of ways. One embodiment has been illustrated in FIG. 19. According to FIG. 19, the requests for offers may be presented in a series of images 1106 (referred to as pages in FIG. 19), each image 1106 in the series including a plurality of images 1108, each image 1108 of the plurality of images representing a separate request for an offer of an exchange. While a particular arrangement of the request information has been selected for the purposes of illustration, the arrangement may be varied in any number of ways. For example, while the requests are represented by a textual description 1110 (e.g., "FLORAL BOUQUET"), the textual description presented may be replaced with a pictorial description (drawing, photograph, etc.) or a combination of textual and pictorial elements. Moreover, while the images 1108 of the plurality of images have been arranged in an array, the images could have been presented one at a time, or in a series of overlapping images, such as in a cascaded view. Arrows 1112 may be included for navigation purposes between the "pages" 1106; for example, the system may receive an input representative of the player's desire to move to the next page 1106 if the player touches an area of a touchscreen overlying the image of the desired arrow. A request for offer may be selected if, for example, the player touches an area of a touchscreen overlying the image 1108 associated with the request (which image 1108 may then be highlighted, for example, by placing a secondary border 1114 about the image 1108), and then touches the touchscreen overlying a "Submit" button 1116.

At block 1016, the server 110 determines that an offer has been received in regard to the motorcycle helmet from the second player, and in regard to the floral bouquet from the second and third players. In regard to the motorcycle helmet, the second player has offered to exchange the motorcycle helmet for the first player's purse. In regard to the floral bouquet, the second player has offered the five free game coupon, and the third player has offered the steak dinner. The server transmits these offers, as well as a plurality of offers from the plurality of other registered players, to the first player at block 1018, and proceeds to block 1020.

Figure 20:
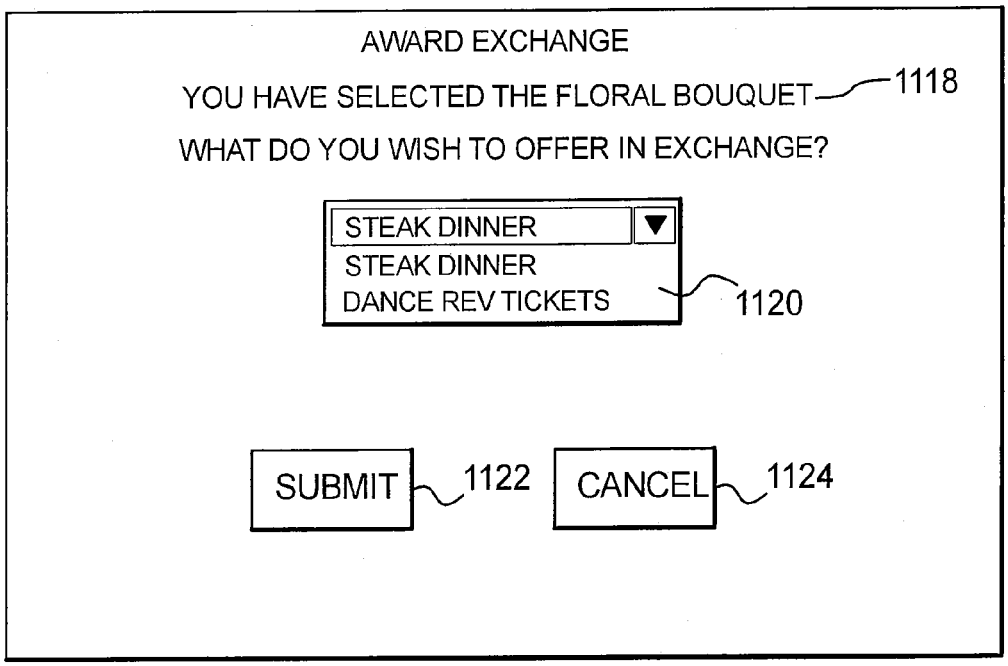
FIG. 20 is an illustration of an embodiment of a third visual display that may be displayed during the performance of the payout exchange routine of FIG. 17.

An embodiment of an image used to receive an input of an offer from a player is illustrated in FIG. 20. The image may include textual or pictorial information 1118 concerning the request that has been selected. In this case, the information is represented textually. Beneath the information 1118 is a list 1120 of the payouts from which the responding player may select a payout to be exchanged for the payout for which an offer has been requested. Similar to the lists 1100, 1102 discussed above, the list 1120 may be an open or closed list. If a closed list, the payout exchange system (specifically, the server 110) may poll either the gaming unit 54, 74, 75, 94 associated with the player making the offer as to which payouts that player has to offer, or the payout exchange system may inquire of another server that tracks such information in regard to the player, such as a bonusing server or a player tracking server, or a combination of the above may occur. The player may select one of the payouts from the list 1120, and then touch the touchscreen overlying a "Submit" button 1122. If, however, the player determines that he or she does not wish to make an offer, the player may instead touch the touchscreen overlying a "Cancel" button 1124.

Figure 21:
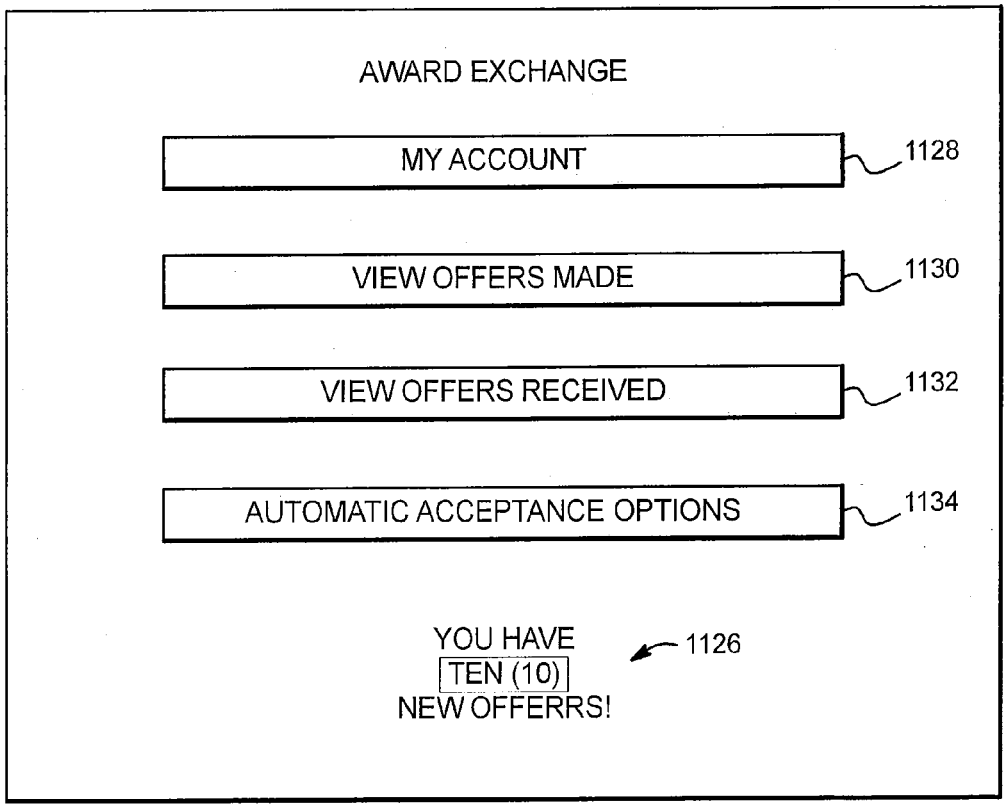
FIG. 21 is an illustration of an embodiment of a fourth visual display that may be displayed during the performance of the payout exchange routine of FIG. 17.
Figure 22:
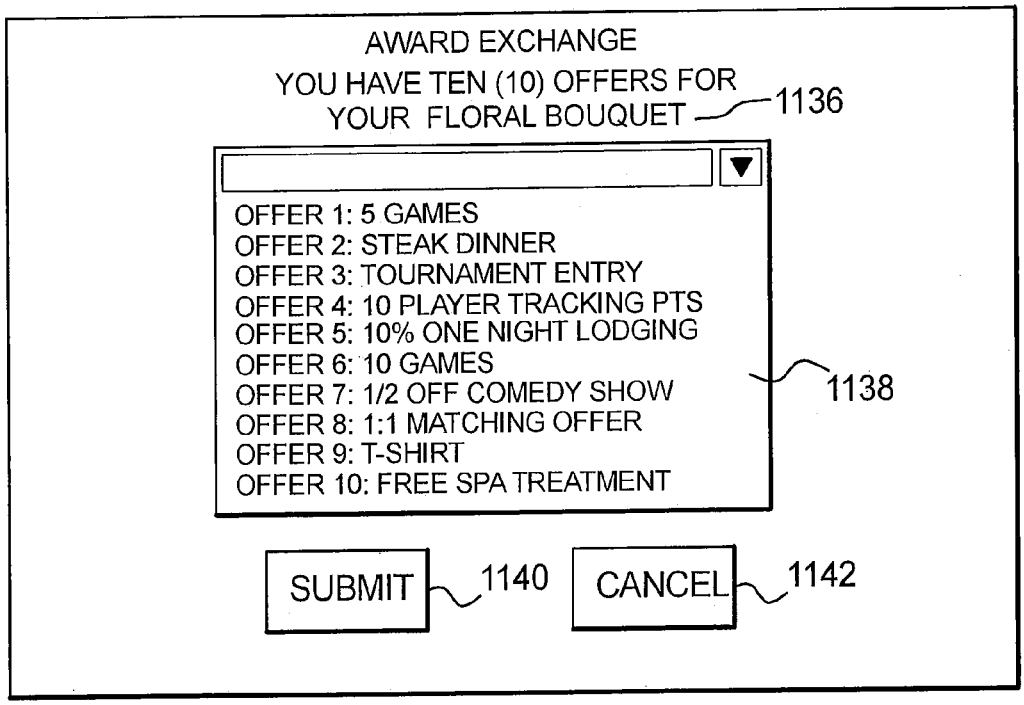
FIG. 22 is an illustration of an embodiment of a fifth visual display that may be displayed during the performance of the payout exchange routine of FIG. 17.

FIG. 21 illustrates an embodiment of an image that may be displayed to a player that is logged in to the payout exchange aspect of the system 50. This image may convey information to the player, in the form of status reports 1126. The image may also be used (in conjunction with an input device, such as a touchscreen) to navigate the payout exchange system, such as through the use of the plurality of buttons 1128, 1130, 1132, 1134 (and associated portions of the associated touchscreen). For example, "My Account" button 1128 may cause the player to view a further image that displays information regarding which payouts presently are associated with the player, which payouts have been offered for exchange, and which requests for offers remain outstanding. The "View Offers Made" button 1130 may cause the player to view an image similar to that shown in FIG. 19, for example. The button "View Offers Received" button 1132 may cause the player to view and image similar to that shown in FIG. 22, which image will be discussed in greater detail below. Lastly, the "Automatic Acceptance Options" button 1134 may permit the player to set rules for automatic review and acceptance of offers, as discussed above.

As is seen in FIG. 21, the status report 1126 prompts the player that ten new offers have been received, which may cause the player to touch the "View Offers Received" button 1132. If the button 1132 is touched, the image of FIG. 22 may be displayed. In this image, an information section 1136 may be provided to alert the player to the request for offers that corresponds to the offers received. If offers were received for more than one request, the offers may be displayed in separate images, although the offers may be displayed in a common image as well. The offers may be arranged in a list 1138, although the disclosure is not limited to such a representation; each offer may be listed separately with a check box associated therewith, or a radio button associated with the group of offers. The player may indicate which offer he or she would like to accept by touching the selected offer in the list of offers and then touching "Submit" button 1140; alternatively, the player may exit the image of FIG. 22 by touching the "Cancel" button 1142.

At block 1020, the server 110 determines that it has received an acceptance from the first player to the exchange of the purse for the motorcycle helmet. The first player may indicate his acceptance of the offer by manipulating an input device associated with the gaming unit associated with the first player, for example by touching an area of a touch screen. Consequently, the server 110 transmits the acceptance to the second player at block 1022. The server 110 also disassociates the purse with the first player and the motorcycle helmet with the second player, and then associates the motorcycle helmet with the first player and the purse with the second player at block 1024.

Figure 23:
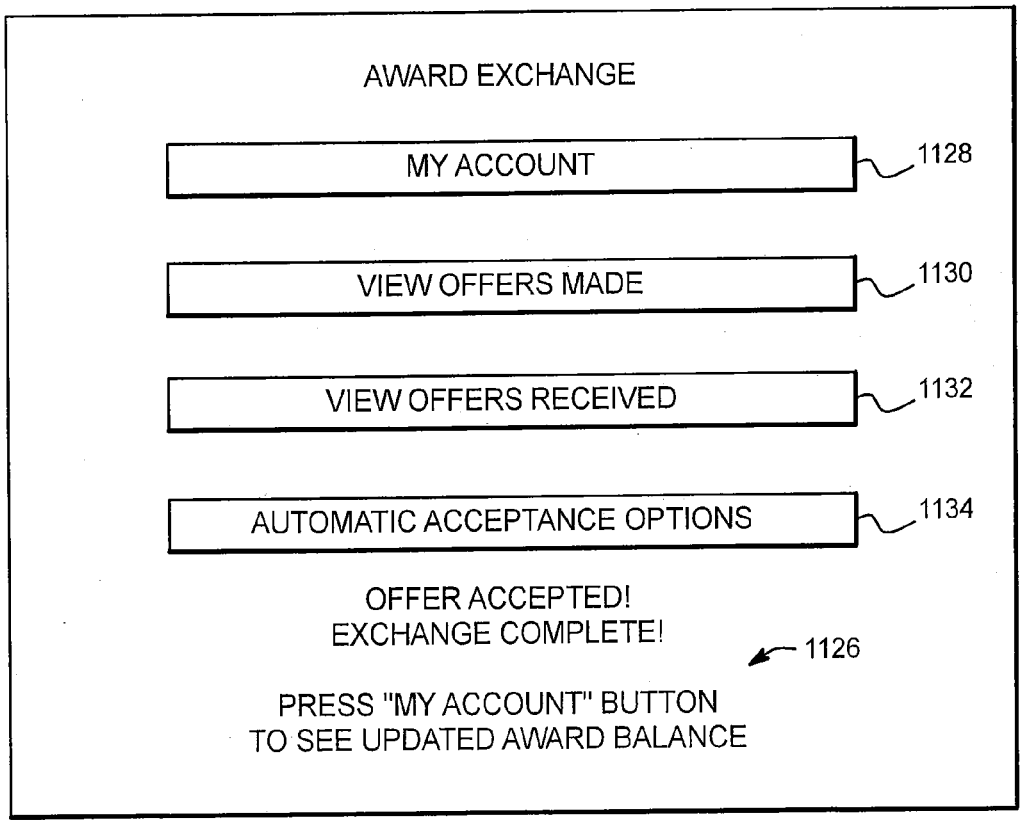
FIG. 23 is an illustration of an embodiment of a sixth visual display that may be displayed during the performance of the payout exchange routine of FIG. 17.

At block 1020, the server 110 may also determine that it has received an acceptance from the first player to the exchange of the floral bouquet for the steak dinner offered by the third player. Consequently, the server 110 transmits the acceptance to the third player at block 1022. The server 110 also disassociates the floral bouquet with the first player and the steak dinner with the third player, and then associates the steak dinner with the first player and the floral bouquet with the third player at block 1024. The association of the steak dinner with the first player and the floral bouquet with the second player may be reflected in an updated status report 1126', as shown in FIG. 23.

At block 1026, the server 110 may determine that the first player has completed his or her use of the payout exchange aspect of the system 50, having exchanged both of the payouts on which the player had requested offers. On the other hand, because the second and third players still have payouts that they wish to exchange, the determination may be made at block 1026 that these players are not finished with their use of the payout exchange aspects of the system 50, and the routine returns to block 1012.

At block 1012, the server 110 may determine that it has received a request for a bartering session from the second player in regard to the five free play payout. The server 110 may broadcast the five free payout as being available for exchange by barter at block 1014 by posting the request to a website dedicated for use as a bartering "clearinghouse." The appearance of one or more webpages at the "clearinghouse" website may be similar to that shown in FIG. 19, wherein the requests for bartering sessions may be presented together. The server 110 may then proceed to block 1016.

The server 110 may further determine at block 1016 that it has received an offer from the third player to barter the tickets for the five free plays. In response, the server transmits the offer to the second player at block 1018 before proceeding to block 1020.

At block 1020, it is determined that an acceptance of the third player's offer has been received. In response, the acceptance is transmitted to the third player at block 1022, and the exchange performed at block 1024 by associating the tickets with the second player and the five free players with the third player. As both the second and third players have now exchanged all of the payouts they had available, the determination may be made at block 1026 that the second and third players have completed their use of the payout exchange aspect of the system 50, and the routine 1000 exits for these players as well at block 1028.

What is claimed is:

1. A gaming method comprising:

receiving a wager from a first player;

displaying an image representative of a game;

determining an outcome for the game represented by the image;

associating a first payout with the first player according to the outcome;

receiving an exchange of communications between the first player and a second player regarding an exchange of the first payout and a second payout;

associating the second payout with the first player; and associating the first payout with the second player.

2. The gaming method according to claim 1, comprising:

receiving a request from the first player to exchange the first payout;

receiving an offer from the second player to exchange the second payout for the first payout; and receiving an acceptance from the first player to exchange the first payout for the second payout.

3. The gaming method according to claim 2, comprising:

broadcasting the request from the first player to a plurality of players including the second player; and transmitting the offer from the second player to the first player.

4. The gaming method according to claim 2, comprising:

receiving an acceptance from the first player to exchange the first payout for the second payout in accordance with an input received from the first player.

5. The gaming method according to claim 2, comprising:

receiving an acceptance from the first player to exchange the first payout for the second payout automatically according to a selection criterion established in advance.

6. The gaming method according to claim 2, comprising:

receiving a wager from the second player;

displaying an image representative of a game;

determining an outcome for the game represented by the image; and associating the second payout with the second player according to the outcome.

7. The gaming method according to claim 1, comprising:

receiving a request from the first player for the second payout;

receiving an offer from the second player to exchange the second payout for the first payout; and receiving an acceptance from the first player to exchange the first payout for the second payout.

8. The gaming method according to claim 7, comprising:

broadcasting the request from the first player to a plurality of players including the second player; and transmitting the offer from the second player to the first player.

9. The gaming method according to claim 7, comprising:

receiving an acceptance from the first player to exchange the first payout for the second payout in accordance with an input received from the first player.

10. The gaming method according to claim 7, comprising:

receiving an acceptance from the first player to exchange the first payout for the second payout automatically according to a selection criterion established in advance.

11. The gaming method according to claim 7, comprising:

receiving a wager from the second player;

displaying an image representative of a game;

determining an outcome for the game represented by the image; and associating the second payout with the second player according to the outcome.

12. The gaming method according to claim 1, comprising:

receiving an offer from the first player directed to the second player to exchange the first payout for the second payout; and receiving an acceptance from the second player to exchange the second payout for the first payout.

13. The gaming method according to claim 12, comprising:

transmitting the offer from the first player to the second player; and transmitting the acceptance from the second player to the first player.

14. The gaming method according to claim 12, comprising:

receiving a wager from the second player;

displaying an image representative of a game;

determining an outcome for the game represented by the image; and associating the second payout with the second player according to the outcome.

15. The gaming method according to claim 1, comprising:

receiving a request from the first player to exchange the first payout;

receiving an offer from the second player to exchange the second payout and a third payout for the first payout;

receiving an acceptance from the first player to exchange the first payout for the second payout and the third payout; and associating the second payout and the third payout with the first player.

16. The gaming method according to claim 1, comprising:

receiving a request from the first player for the second payout;

receiving an offer from the second player to exchange the second payout for the first payout and a third payout;

receiving an acceptance from the first player to exchange the first payout and the third payout for the second payout; and associating the first payout and the third payout with the second player.

17. The gaming method according to claim 1, comprising:

receiving an offer from the first player directed to the second player to exchange the first payout and a third payout for the second payout;

receiving an acceptance from the second player to exchange the second payout for the first payout and the third payout; and associating the first payout and the third payout with the second player.

18. The gaming method according to claim 1, comprising:

receiving an offer from the first player directed to the second player to exchange the first payout and a third payout for the second payout and a fourth payout;

receiving an acceptance from the second player to exchange the second payout and the fourth payout for the first payout and the third payout;

associating the second payout and the fourth payout with the first player; and associating the first payout and the third payout with the second player.

19. A gaming system comprising:

a gaming apparatus including:

a value input device;

a display unit; and a controller having a processor and a memory operatively coupled to the processor, the controller operatively coupled to the value input device and the display unit, the controller being programmed to receive a wager from a first player via the value input device;

the controller being programmed to cause the display unit to generate an image representative of a game;

the controller being programmed to determine an outcome for the game represented by the image;

the controller being programmed to associate a first payout with the first player according to the outcome; and a payout exchange computer having a processor and memory operatively coupled to the processor;

the payout exchange computer being programmed to receive an exchange of communications between the first player and a second player regarding an exchange of the first payout and a second payout;

the payout exchange computer being programmed to associate the second payout with the first player; and the payout exchange computer being programmed to associate the first payout with the second player.

20. The gaming system according to claim 19, wherein:

the payout exchange computer is programmed to receive a request from the first player to exchange the first payout;

the payout exchange computer is programmed to receive an offer from the second player to exchange the second payout for the first payout; and the payout exchange computer is programmed to receive an acceptance from the first player to exchange the first payout for the second payout.

21. The gaming system according to claim 20, wherein:

the payout exchange computer is programmed to broadcast the request from the first player to a plurality of players including the second player; and the payout exchange computer is programmed to transmit the offer from the second player to the first player.

22. The gaming system according to claim 20, comprising:

the payout exchange computer is programmed to receive an acceptance from the first player to exchange the first payout for the second payout in accordance with an input received from the first player.

23. The gaming system according to claim 20, comprising:

the payout exchange computer is programmed to receive an acceptance from the first player to exchange the first payout for the second payout automatically according to a selection criterion established in advance.

24. The gaming system according to claim 20, comprising:

another gaming apparatus including:

a value input device;

a display unit; and a controller having a processor and a memory operatively coupled to the processor, the controller operatively coupled to the value input device and the display unit, the controller being programmed to receive a wager from the second player via the value input device;

the controller being programmed to cause the display unit to generate an image representative of a game;

the controller being programmed to determine an outcome for the game represented by the image;

the controller being programmed to associate the second payout with the second player according to the outcome.

25. The gaming system according to claim 19, wherein:

the payout exchange computer is programmed to receive a request from the first player for the second payout;

the payout exchange computer is programmed to receive an offer from the second player to exchange the second payout for the first payout; and the payout exchange computer is programmed to receive an acceptance from the first player to exchange the first payout for the second payout.

26. The gaming system according to claim 25, wherein:

the payout exchange computer is programmed to broadcast the request from the first player to a plurality of players including the second player; and the payout exchange computer is programmed to transmit the offer from the second player to the first player.

27. The gaming system according to claim 25, comprising:

the payout exchange computer is programmed to receive an acceptance from the first player to exchange the first payout for the second payout in accordance with an input received from the first player.

28. The gaming system according to claim 25, comprising:

the payout exchange computer is programmed to receive an acceptance from the first player to exchange the first payout for the second payout automatically according to a selection criterion established in advance.

29. The gaming system according to claim 25, comprising:

another gaming apparatus including:

a value input device;

a display unit; and a controller having a processor and a memory operatively coupled to the processor, the controller operatively coupled to the value input device and the display unit, the controller being programmed to receive a wager from the second player via the value input device;

the controller being programmed to cause the display unit to generate an image representative of a game;

the controller being programmed to determine an outcome for the game represented by the image;

the controller being programmed to associate the second payout with the second player according to the outcome.

30. The gaming system according to claim 19, wherein:

the payout exchange computer is programmed to receive an offer from the first player directed to the second player to exchange the first payout for the second payout; and the payout exchange computer is programmed to receive an acceptance from the second player to exchange the second payout for the first payout.

31. The gaming system according to claim 30, wherein:

the payout exchange computer is programmed to transmit the offer from the first player to the second player; and the payout exchange computer is programmed to transmit the acceptance from the second player to the first player.

32. The gaming system according to claim 30, comprising:

another gaming apparatus including:

a value input device;

a display unit; and a controller having a processor and a memory operatively coupled to the processor, the controller operatively coupled to the value input device and the display unit, the controller being programmed to receive a wager from the second player via the value input device;

the controller being programmed to cause the display unit to generate an image representative of a game;

the controller being programmed to determine an outcome for the game represented by the image;

the controller being programmed to associate the second payout with the second player according to the outcome.

33. The gaming system according to claim 19, wherein:

the payout exchange computer is programmed to receive a request from the first player to exchange the first payout;

the payout exchange computer is programmed to receive an offer from the second player to exchange the second payout and a third payout for the first payout;

the payout exchange computer is programmed to receive an acceptance from the first player to exchange the first payout for the second payout and the third payout; and the payout exchange computer is programmed to associate the second payout and the third payout with the first player.

34. The gaming system according to claim 19, wherein:

the payout exchange computer is programmed to receive a request from the first player for the second payout;

the payout exchange computer is programmed to receive an offer from the second player to exchange the second payout for the first payout and a third payout;

the payout exchange computer is programmed to receive an acceptance from the first player to exchange the first payout and the third payout for the second payout; and the payout exchange computer is programmed to associate the first payout and the third payout with the second player.

35. The gaming system according to claim 19, wherein:

the payout exchange computer is programmed to receive an offer from the first player directed to the second player to exchange the first payout and a third payout for the second payout;

the payout exchange computer is programmed to receive an acceptance from the second player to exchange the second payout for the first payout and the third payout; and the payout exchange computer is programmed to associate the first payout and the third payout with the second player.

36. The gaming system according to claim 19, wherein:

the payout exchange computer is programmed to receiving an offer from the first player directed to the second player to exchange the first payout and a third payout for the second payout and a fourth payout;

the payout exchange computer is programmed to receive an acceptance from the second player to exchange the second payout and the fourth payout for the first payout and the third payout;

the payout exchange computer is programmed to associate the second payout and the fourth payout with the first player; and the payout exchange computer is programmed to associate the first payout and the third payout with the second player.

37. The gaming system according to claim 19, wherein the payout exchange computer comprises a server.

38. The gaming system according to claim 19, wherein:

the payout exchange computer comprises another gaming apparatus;

the another gaming apparatus including a value input device and a display unit, the value input device and display unit operatively coupled to the payout exchange computer controller; and the payout exchange computer controller is programmed to receive a wager from a player via the value input device, to cause the display unit to generate an image representative of a game, to determine an outcome for the game represented by the image, and to associate a payout with the player according to the outcome.

39. The gaming system according to claim 19, comprising a network coupling the gaming apparatus and the payout exchange computer.

40. The gaming system according to claim 39, wherein the network comprises at least one of a local area network, a wide area network, an intranet, and the Internet.

41. The gaming system according to claim 19, comprising:

a first personal communication unit in communication with the payout exchange computer, the first personal communication unit including a controller having a processor and a memory, the controller of the first personal communication unit being programmed to transmit a communication from the second player to the payout exchange computer, the communication concerning the second payout.

42. The gaming system according to claim 41, comprising:

a second personal communication unit in communication with the payout exchange computer, the second personal communication unit including a controller having a processor and a memory, the controller of the second personal communication unit being programmed to transmit a communication from the first player to the payout exchange computer, the first communication concerning the first payout.

* * * * *